US005735163A

United States Patent [19]

Sato et al.

[11] Patent Number: 5,735,163

[45] Date of Patent: Apr. 7, 1998

[54] PRESS WORKING METHOD INCLUDING STEP OF STRENGTHENING LOCAL PORTION OF BLANK

[75] Inventors: Akihito Sato, Toyota; Shinichiro Nakamura, Nagoya; Takashi Hosoe, Toyota, all of Japan

[73] Assignee: Toyota Jidosha Kabushiki Kaisha, Japan

[21] Appl. No.: 518,828

[22] Filed: Aug. 24, 1995

[30] Foreign Application Priority Data

| | | | |
|---|---|---|---|
| Aug. 29, 1994 | [JP] | Japan | 6-203281 |
| May 15, 1995 | [JP] | Japan | 7-115497 |

[51] Int. Cl.[6] ..... B21D 22/00; B21D 22/21; B21C 37/02

[52] U.S. Cl. ..... 72/348; 72/379.2

[58] Field of Search ..... 72/347, 348, 379.2, 72/342.1, 342.5, 342.6, 364, 379.4, 701; 148/643, 648, 654, 515, 565; 29/DIG. 49

[56] References Cited

U.S. PATENT DOCUMENTS

| | | | |
|---|---|---|---|
| 753,248 | 3/1904 | Duff | 72/342.5 |
| 1,580,931 | 4/1926 | Thackray | 72/342.6 |
| 4,413,495 | 11/1983 | Peuhkurinen et al. | 72/379.2 |
| 4,503,696 | 3/1985 | Roeder | 72/379.2 |

FOREIGN PATENT DOCUMENTS

| | | |
|---|---|---|
| 0 030 715 | 6/1981 | European Pat. Off. . |
| 0 251 759 | 1/1988 | European Pat. Off. . |
| 19 35 933 | 1/1970 | Germany . |
| 1752186 | 4/1971 | Germany . |
| 62-13092 | 2/1988 | Japan . |
| 1-259118 | 10/1989 | Japan . |
| 4-72010 | 3/1992 | Japan . |
| 4-105721 | 4/1992 | Japan . |

OTHER PUBLICATIONS

Patent Abstracts of Japan, vol. 4, No. 99 (M–021), Jul. 16, 1980.

Patent Abstracts of Japan, vol. 14, No. 17 (C–675), Jan. 16, 1990.

Patent Abstracts of Japan, vol. 16, No. 346 (M–1286), Jul. 27, 1992.

Patent Abstracts of Japan, vol. 16, No. 277 (C–0954), Jun. 22, 1992.

European Search Report dated Mar. 5, 1996 (2 pages).

Communication dated Mar. 26, 1996 (1 page).

*Primary Examiner*—Lowell A. Larson
*Assistant Examiner*—Rodney Butler
*Attorney, Agent, or Firm*—Finnegan, Henderson, Farabow, Garrett, & Dunner, L.L.P.

[57] ABSTRACT

A method of effecting press working on a blank, in which a local portion of the blank is strengthened prior to the press working, so as to achieve increased mechanical strength, due to structural transformation of the material of the blank, or by an embossing operation. The local portion is selected so that the blank exhibits improved formability and suffers from reduced fractures during the press working.

16 Claims, 19 Drawing Sheets

(I)

(II)

(III)

(IV)

| | BEFORE DEFORMATION | AFTER DEFORMATION |
|---|---|---|
| BIAXIAL DEFORMATION | | |
| PLANE STRAIN DEFORMATION | | |
| UNIAXIAL DEFORMATION | | |

PRESS WORKING METHOD INCLUDING STEP OF STRENGTHENING LOCAL PORTION OF BLANK

BACKGROUND OF THE INVENTION

1. Field of the Invention

The present invention relates to a method of effecting press working on a blank, and in particular to a technique for improving the formability of the blank, by strengthening a local portion of the blank so as to increase the mechanical strength thereof, in a manner suitable for the kind of the press working.

2. Discussion of Related Art

Various kinds of press working or plastic working, such as bending and drawing, have been widely employed to form various automobile panels, for example. In press working, a blank or a sheet of metal undergoes plastic deformation, and is formed into a desired shape. To improve the mechanical strength of a formed piece obtained by such press working, a desired portion of the formed piece may be heated by applying thereto a beam having a high energy density, and quenched or rapidly cooled, so as to form a bainite or martensite structure having high strength. Thus, the desired portion of the formed piece can be strengthened due to the structural transformation thereof, as disclosed in JP-A-4-72010, for example. It is also proposed in JP-A-1-259118 to partially strengthen a blank by applying a high energy density beam to a local portion of the blank, prior to the press working, so as to improve the tensile rigidity and dent resistance of the formed piece obtained by the press working. Such a high energy density beam may also be applied to a blank before the press working, so as to strengthen a portion of the blank which is held in contact with a pressure member, such as a pressure ring, during drawing, as disclosed in JP-A-4-105721. Thus, the resistance to deformation of the blank is adjusted to control the amount of material flow or inward movement distance of the blank relative to a die and a pressure member so as to avoid creases or wrinkles in the formed piece. To achieve improved mechanical strength, a blank may also be subjected to an embossing operation, for example, so that the embossed portion undergoes compressive deformation, and is thus strengthened due to work hardening or strain hardening, as disclosed in JP-B2-62-13092.

The formed piece or blank is locally strengthened as described above so as to improve the mechanical strength and dent resistance of the formed piece, or control the tension applied to the blank during drawing. However, the known strengthening processes are not expected to improve the formability of the blank, and thus permit the use of a lower-grade material having low formability as the blank, which leads to a reduced material cost, or makes it possible to form such articles that cannot conventionally be formed by press working. Further, the known techniques do not aim at preventing springback and assuring an improved dimensional accuracy of the formed piece. The formability of the blank used in press working is generally determined by mechanical properties of the blank material, such as elongation, tensile strength, n-value and r-value (Lankford value). The higher the formability is, the fewer fractures are formed during the press working. While the blank material is required to exhibit a given degree of formability depending upon the shape of the formed piece, it pushes up the material cost to use a high-grade material which exhibits high formability and is less likely to form fractures. That is, it is desirable to employ an inexpensive material of lower grade to reduce the material cost, if it meets the requirement for the formability. It is also desirable to reduce the springback which may occur during press working, so as to assure improved formability and dimensional accuracy.

SUMMARY OF THE INVENTION

It is therefore an object of the present invention to provide a press working method wherein a local portion of a blank is strengthened to improve the formability of the blank and thus prevent fracturing and springback of the blank during the press working.

The above object may be accomplished according to a first aspect of the present invention, which provides a method of effecting press working on a blank, comprising the steps of: strengthening a local portion of the blank so as to increase a mechanical strength thereof, the local portion being elongated during an initial period of a pressing step and being prone to fracture due to stress concentration as the press working proceeds; and after strengthening the local portion, effecting the pressing step wherein a central portion of the blank is pressed against a punch while the blank is held under pressure at an outer peripheral portion thereof, so that the blank undergoes plastic deformation according to a shape of the punch.

The above-described method is applicable to a press working process, such as drawing and bending, which involves elongation and plastic deformation of the blank, for forming an article having a desired shape. The blank includes stress-concentrated portions which are prone to fracture during the press working step, more specifically, such portions that are brought into contact with a shoulder or a distal end portion of the punch used for the press working. In the present method, these stress-concentrated portions are strengthened to provide increased mechanical strength, such as improved tensile strength, and improved fracture force, which leads to reduced fractures. While the use of a high-strength steel plate for the blank may improve the fracture force, it also results in an increased forming load required to press the steel plate, and does not contribute to reduction of fractures. If only the stress-concentrated portions are strengthened as in the present invention, the forming load required for the press working hardly changes, and fractures are effectively prevented at the strengthened portions. This makes it possible to use a material of lower grade than a conventionally used material, or to form an article which cannot be formed by the conventional press working method.

In one preferred form of the invention suitable for increasing the mechanical strength of the blank, a desired portion of the blank may be heated by application of a high energy, and then quenched, so that the structure of the blank material is transformed into a bainite or martensite structure having high strength. In another form of the invention, the blank may be subjected to an embossing or coining operation, so that a local portion of the blank undergoes compressive deformation, and is thus strengthened due to strain hardening or strain aging, for example. Other blank processing operations may be employed for locally strengthening the blank so as to increase the mechanical strength.

When linearly strengthened portions are formed in the blank, by applying a high energy density beam to cause the structural transformation of the blank material, or by embossing or coining the blank, for example, the tensile strength of the blank may be varied in different directions. For instance, if one or more linearly strengthened portions are formed in a direction of elongation of the blank which intersects at substantially right angles with the direction in which fractures are formed, in other words, in a direction in which a tension acts on the blank during the press working step, the resistance to elongation or deformation is increased primarily in the direction of elongation, whereby fracturing of the blank is effectively avoided without affecting deformation of the blank in the other directions. The length of the linearly strengthened portions is sufficiently large if it is about 40 mm, and the distance or interval between the adjacent strengthened portions is desirably about 20 mm or smaller. However, the length and interval of the strengthened portions may be otherwise determined, depending upon the material of the blank and the shape of the formed piece.

The object as described above may also be accomplished according to a second aspect of the present invention, which provides a method of effecting press working on a blank, comprising the steps of: strengthening a local portion of the blank so as to increase a mechanical strength thereof, the local portion being subjected to a bulging operation, in a pressing step wherein an outer peripheral portion of the blank surrounding the local portion would be difficult to be inwardly moved relative to a pressure member which is in contact with the outer peripheral portion to hold the blank; and after strengthening the local portion, effecting the pressing step wherein the blank is pressed against a punch so that the blank undergoes plastic deformation according to a shape of the punch.

In the above-described method, the local portion formed by bulging is strengthened so as to increase the mechanical strength, and improve the fracture force, which leads to reduced fractures of the blank. When a local portion of the blank is formed by bulging, an outer peripheral portion of the blank usually flows or moves inwardly, to only a limited extent, relative to the pressure member during the bulging operation. By strengthening such local portion prior to the pressing step, however, the inward movement distance or amount of material flow of the blank at its outer peripheral portion can be increased, depending upon the degree of strengthening or hardening of the local bulged portion. When the bulged portion formed is a central part of the blank, for example, it is difficult to control the amount of material flow or inward movement distance of the blank at the outer peripheral portion, by adjusting a blank-holding force applied to the outer peripheral or flange portion of the blank. In such a case, too, the strengthening of the local portion causes an increase in the material flow or movement at the flange portion, so as to form the bulged central portion, with improved formability and reduced fracturing of the blank. This permits the use of a material of lower grade than a conventionally used[material, and makes it possible to form an article which cannot be formed by the conventional press working method.

The above-indicated local portion may be strengthened to provide at least one linearly strengthened portion, which is formed in substantially parallel with the direction in which the tension acts on the bulged portion during the bulging operation. In this case, the bulged portion exhibits increased resistance to deformation primarily in the direction of the tension, whereby the blank material can be effectively inwardly moved from its surrounding portion, without affecting the deformation of the bulged portion in the other directions.

The above object may also be accomplished according to a third aspect of the present invention, which provides a method of effecting a press working on a blank, comprising the steps of: strengthening a local portion of the blank to increase a mechanical strength thereof, by changing a type of deformation of the blank in a pressing step, thereby to increase an amount of strain at a forming limit of the blank; and after strengthening the local portion, effecting the pressing step wherein a central portion of the blank is pressed against a punch while the blank is held under pressure at an outer peripheral portion thereof, so that the blank undergoes plastic deformation according to a shape of the punch.

The above-described method is applicable to a press working process, such as drawing and bending, which involves elongation and plastic deformation of the blank, for forming an article having a desired shape. By strengthening the local portion of the blank, the type of deformation of the blank can be changed in the pressing step, thereby to increase the amount of strain at the forming limit of the blank. The thus increased amount of strain at the forming limit leads to reduction of fractures formed in the blank during the press working. This permits the use of a material of lower grade than a conventionally used material, and makes it possible to form an article which cannot be formed by press working.

The types of deformation of a blank during press working may be defined by the relationship between a strain $\epsilon x$ in the direction of x-axis in which the tension is applied to the blank, and a strain $\epsilon y$ in the direction of y-axis which is perpendicular to that of the tension, in a two-dimensional coordinate system in the plane of the blank. Generally, when the blank undergoes plain strain deformation in which the strain $\epsilon y$ in the y-axis direction is substantially zero, the amount of strain at the forming limit at which fractures are formed has the smallest value, that is, $\sqrt{(\epsilon x^2+\epsilon y^2)}$, as shown in the graph of FIG. 13. This amount of strain is increased when the blank undergoes biaxial deformation in which the strain $\epsilon y$ in the y-axis direction is a positive value, or uniaxial deformation in which the strain $\epsilon y$ is a negative value. By locally strengthening the blank, the tensile strength is increased in a particular direction, with a result of reduced elongation of the blank in that direction, whereby the type of deformation of the blank is changed. For instance, the plain strain deformation may be changed to the biaxial deformation or uniaxial deformation, so as to increase the amount of strain at the forming limit.

When linearly strengthened portions are formed on the blank, the tensile strength is increased primarily in the direction of extension of the linearly strengthened portions, which results in reduced elongation of the blank in that direction. In the case where the type of deformation of the blank is changed so as to increase the tensile strength in a direction in which the tension acts on the blank during the press working, it is desirable to form a large number of linearly strengthened portions in a direction perpendicular to the direction of the tension, such that the strengthened portions are spaced a suitable distance from each other in the direction of the tension. Each linearly strengthened portion may have a relatively short length, in a range of several millimeters to several tens of millimeters.

The above object may also be attained according to a fourth aspect of the present invention, which provides a method of effecting press working on a blank, comprising: strengthening a local portion of the blank to increase a mechanical strength thereof, the local portion being formed near a portion of the blank which is to be bent in a pressing step, at one of opposite surfaces of the blank which is to be located on the outside of the bent portion; and after strengthening the local portion, effecting the pressing step wherein the blank is pressed to cause plastic deformation thereof according to a predetermined shape.

The above-described method is applicable to a press working process which involves bending deformation. That is, the strengthening process is effected on a portion of the blank which will be on the outer side of a bend of a formed piece, so as to increase the mechanical strength of that portion. This may be achieved by applying a high energy to a local portion of the blank adjacent to the bend to be formed, to cause the structural transformation of the blank material, or by embossing a local portion of the blank to cause the compressive deformation. If the local portion of the blank is heated by application of a high energy and quenched, and is thus transformed into a martensite or bainite structure, the volume of the local portion is increased due to the structural transformation, and relatively large compressive stresses arise on the side of the blank to which the high energy is applied, that is, on the outer side of a bend that is to be formed by bending the blank. If the compressive deformation due to the embossing operation takes place on a portion of the blank which will be on the outer side of a bend to be formed, relatively large compressive stresses arise in the deformed portion which is on the outer side of the bend to be formed. When the blank is bent by press working to form a bend or bent portion, on the other hand, tensile stresses arise on the outer side of the bend, and compressive stresses arise on the inner side of the bend, which stresses result in springback of the blank. Since the compressive residual stresses are present on the outer side of the bend due to the strengthening process as described above, the tensile stresses due to the bending deformation may be cancelled or offset by the compressive residual stresses, whereby a resulting formed piece does not suffer from springback, and exhibits improved dimensional accuracy. Thus, the above method is particularly favorably employed when the bending operation involves unexpected springback of the blank, which results in poor dimensional accuracy of the formed piece.

When the strengthening of the local portion of the blank is achieved by the structural transformation as described above, the blank is not necessarily strengthened through the entire thickness thereof. If the blank is partially fused and quenched only at its portion on the outer side of the bend to be formed, the compressive residual stresses differ largely between the opposite surfaces of the blank, and the springback can be more effectively prevented, as compared with that when the blank is fused through the entire thickness thereof.

In any of the above-described methods according to the first to fourth aspects of the invention, the blank may be strengthened by heating its local portion by application of a high energy thereto, and quenching the local portion, thereby to cause structural transformation of the material of the blank, which results in increased mechanical strength of the local portion.

By heating and quenching as described above, the structure of the local portion of the blank is transformed into a high-strength martensite or bainite structure, for example, which has a tensile strength of about 450 MPa or higher. The local portion of the blank may be heated by irradiating that portion with a high energy density beam, such as a laser beam, plasma beam, electronic beam, or ion beam, which permits heating of limited areas of the local portion. However, the blank may be locally heated in other manners, using a high-frequency or microwave heating device, for example. The heating temperature is equal to or higher than the temperature at which the martensite transformation takes place. While a blank formed of carbon steel may be heated at about 727° C. or higher, it is desirable to heat the steel up to a temperature higher than its fusing temperature, to ensure that the desired areas of the local portion of the blank are sufficiently strengthened by the structural transformation. If a small or narrow area of the blank is heated as described above, the heated area may be quenched by auto-cooling, since the heat is transmitted to its surrounding portions. However, a suitable cooling process may be effected, as needed, to quench the heated area.

Preferably, the material of the blank is a carbon steel which contains a suitable amount of carbon and performs the martensite transformation or bainite transformation. Such a carbon steel plate may be plated with fused zinc, to form a Zn—Fe layer having rust-proof property on the outer surface of the steel plate. To prevent evaporation of the Zn—Fe layer by application of the high energy thereto, the Zn—Fe layer may be heated at a temperature lower than its evaporating temperature, or the area of the Zn—Fe layer which receives the high energy density beam may be reduced. It is also desirable to determine various conditions in strengthening the local portion of the blank due to the structural transformation, in view of a rust-proof coating other than the Zn—Fe layer, or other coating formed on the outer surface of the blank. That is, the blank may be locally heated at a temperature which is lower than the evaporating or fusing temperature of such a coating.

In any of the above-described methods according to the first to fourth aspects of the invention, the blank may also be strengthened by embossing a local portion of the blank so as to cause compressive deformation thereof, which leads to improved mechanical strength of the local portion.

In the embossing operation, the local portion of the blank is strengthened due to strain hardening or strain aging. Although the degree of the increase in the strength achieved by this strengthening process is not so large as that achieved by the above process utilizing the high energy density beam, the instant process is favorably employed when the blank is plated with fused zinc, or provided with other coating. Further, the embossing operation is advantageously effected on a blank formed of various materials whose mechanical strength increases with the strain hardening or strain aging, for example. Since the embossed portions of the blank have reduced thickness as compared with the other portions, the blank-holding pressure can be reduced during the press working if a portion of the blank held by two pressure members includes the embossed portions, resulting in reduced possibility of breakage or rupture of the blank. Moreover, the embossed portions may be formed by pressing the blank against a suitable die, requiring a relatively low cost for installation and maintenance for effecting the embossing operation.

BRIEF DESCRIPTION OF THE DRAWINGS

The above and optional objects, features, advantages and significant aspects of the present invention will become more apparent by reading the following detailed description of presently preferred embodiments of the invention, when considered in connection with the accompanying drawings, in which.

DETAILED DESCRIPTION OF PREFERRED EMBODIMENTS

Referring first to FIGS. 1A–1E, there are shown formed pieces 10*a*–10*e* which are formed by cup drawing or rectangular drawing. To obtain each of the formed pieces 10*a*–10*e*, a central portion of a circular or rectangular sheet of metal or blank is pressed against a punch while the blank is gripped at its outer peripheral portion by and between a die and a pressure ring, so as to cause plastic deformation of the blank following the shape of the punch. The formed pieces 10*a*–10*e* have stress-concentrated portions which are elongated during an initial period of press working and on which stresses are concentrated as the press working proceeds, causing fractures to be formed. In these stress-concentrated portions, linearly strengthened portions 12*a*–12*e* are formed as shown in FIGS. 1A–1E, through structural transformation of the material of the blank, which is achieved by applying a high energy to heat appropriate portions 12*a*–12*e* and quenching or rapidly cooling these portions 12*a*–12*e* to form a martensite structure or bainite structure. The thus strengthened portions 12*a*–12*e* exhibit increased mechanical strength, such as tensile strength. More specifically, a local point of the blank is irradiated by a beam having a high energy density, such as a plasma beam, electronic beam, or ion beam, and the point of irradiation of the beam is then shifted or moved at a given speed along predetermined lines, while heating and fusing the irradiated points. As a result, the blank is hardened along the predetermined lines, through the fusion and self-cooling of the metal, to thus form each of the linearly strengthened portions 12a–12e. The material of the blank may be a carbon steel which contains a suitable amount of carbon and may undergo the martensite transformation or bainite transformation. When a sheet of carbon steel plated with fused zinc is locally strengthened by the structural transformation as described above, a Zn—Fe layer formed on the surface of the steel sheet is evaporated by heat applied thereto. In the present embodiment, however, the high energy density beam is used to heat only local parts along lines, of the steel sheet. Therefore, only a small area of the Zn—Fe layer is evaporated, without affecting the rust-proof property of the Zn—Fe layer.

Figure 1A:
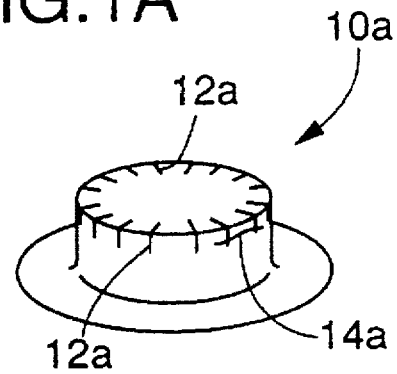
FIG. 1A through FIG. 1E are perspective views showing examples of a formed piece produced by a press working method according to the present invention.
Figure 1B:
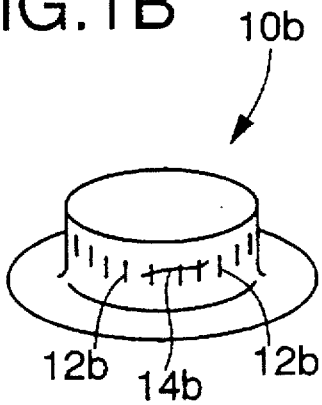
Figure 1C:
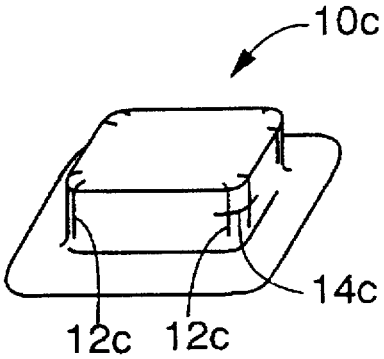
Figure 1D:
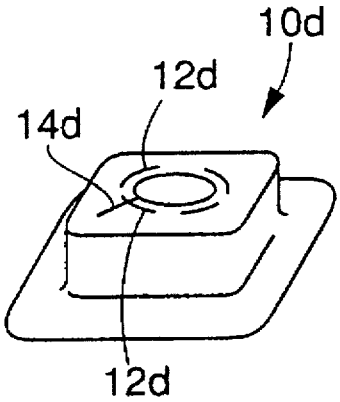
Figure 1E:
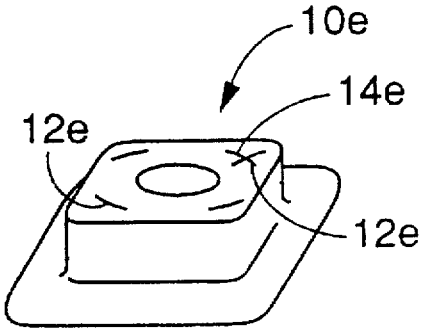

The linearly strengthened portions 12a–12e are formed in each blank prior to the press working or drawing, so as to improve its fracture force, and thus avoid fractures 14a–14e during the press working. More specifically explained with respect to the formed piece 10a, a fracture 14a may be formed in its portion which contacts the shoulder of the punch during drawing, such that the fracture 14a extends in a direction substantially parallel to the punch shoulder. To prevent the fracture 14a, a multiplicity of linearly strengthened portions 12a are formed at a predetermined angular interval in a blank which gives the formed piece 10a, such that the portions 12a extend in a direction substantially parallel to the direction in which the tension acts on the blank during the press working, so as to intersect at right angles with the punch shoulder. The formed piece 10b may suffer from a fracture 14b formed in its cylindrical side wall in the circumferential direction, as indicated in FIG. 1B. To prevent the fracture 14b, a multiplicity of linearly strengthened portions 12b are formed at a predetermined angular interval in a blank which gives the formed piece 10b, in a direction substantially parallel to the axis of the cylindrical wall of the piece 10b. The formed piece 10c formed by rectangular drawing may have a fracture 14c formed around a corner connecting its adjacent side walls, in the circumferential direction of its rectangularly drawn part, as indicated in FIG. 1C. To prevent the fracture 14c, two linearly strengthened portions 12c corresponding to each corner are formed in a blank which gives the formed piece 10c, in a direction substantially parallel to the direction in which the tension acts on the blank during press working, that is, in a direction substantially parallel to the axis of the rectangularly drawn part. The formed piece 10d of FIG. 1D is formed by rectangular drawing, using a blank having a circular center hole. A fracture 14d which may occur in the formed piece 10d extends from the center hole toward one of the four corners of its rectangularly drawn part. To prevent the fracture 14d, four linearly strengthened portions 12d corresponding to the respective corners are formed in a direction substantially parallel to the direction of the tensile strength applied to the blank during the press working, along a circle which is concentric with and has a somewhat larger diameter than the circular center hole. The formed piece 10e show in FIG. 1E is also formed by rectangular drawing, using a blank having a circular center hole. In this case, a fracture 14e may be formed radially outwardly of the center hole, in the vicinity of one of four corners of the rectangularly drawn part. To prevent the fracture 14e, four linearly strengthened portions 12e corresponding to the respective corners are formed in a direction substantially parallel to the direction in which the tensile strength acts on the blank during the press working. That is, the strengthened portions 12e are formed near the four corners of the rectangularly drawn part, along a circle which is concentric with the circular center hole.

Figure 17:
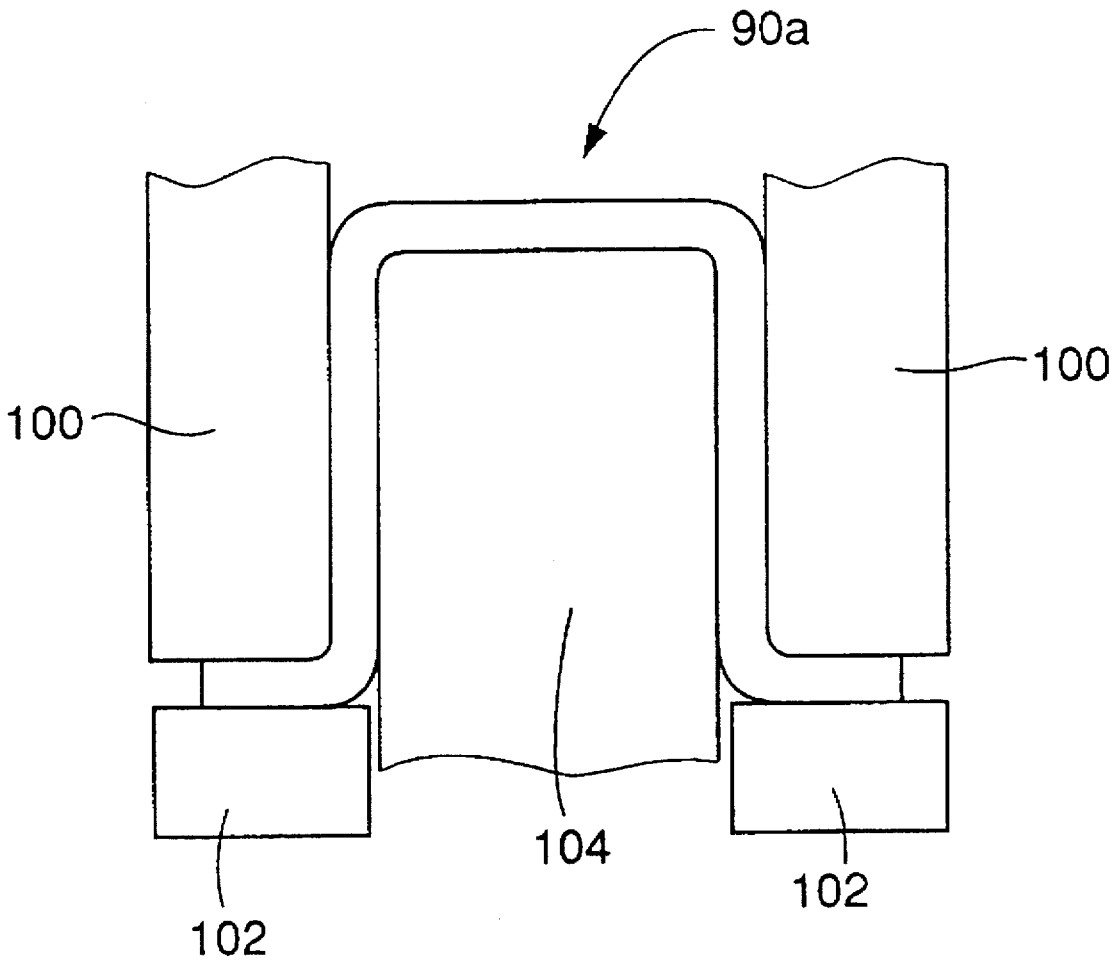
FIG. 17 is a view showing a press used for producing the formed piece of FIG. 16A.

The number, length and interval of the linearly strengthened portions 12a–12e may be suitably determined as desired. Such linearly strengthened portions may also be provided in a hat-shaped piece formed by bending, as indicated at 90a in FIG. 17, or other pieces formed by press working, other than cupping, rectangular drawing, and bending. When a hat-shaped piece is formed by bending as shown in FIG. 17, a plurality of linearly strengthened portions may be provided at upper bends and side walls adjacent to the bends, in a direction substantially parallel to the direction of the tension applied thereto.

In the instant embodiment, the stress-concentrated portions which are prone to have fractures 14a–14e are locally strengthened as described above, due to the structural transformation of the blank material, so that the linearly strengthened portions 12a–12e are formed which exhibit an increased fracture force. Therefore, the fractures 14a–14e are less likely to be formed, and an inexpensive material of lower grade may be used to form the pieces 10a–10e at a reduced cost. The linearly strengthened portions 12a–12e also permit formation of such pieces that cannot be conventionally formed by press working. In this embodiment, in particular, the linearly strengthened portions 12a–12e are formed in a direction parallel to the direction of the tension applied to the blank, in other words, in a direction intersecting at substantially right angles with the fractures 14a–14e which would be otherwise formed by stress concentration. Accordingly, the blanks having the strengthened portions 12a–12e provide increased resistance to deformation in the direction of the tension, with a result of reduced fractures, without affecting deformation of the blank in the other directions.

If a steel sheet having high strength is used as a blank to be pressed, the fracture force is accordingly improved, but fractures may not be sufficiently prevented, due to an increased forming or pressing load required to press the steel sheet. Since only the stress-concentrated portions of the blank are locally strengthened in the present embodiment, the forming load or force required to press the blank hardly changes, and the fractures 14a–14b are thus effectively prevented from being formed in the stress-concentrated portions. More specifically described referring to FIG. 2, for example, a blank 24 is subjected to cupping drawing, by moving a punch 26 upwards relative to a die 20 and a pressure ring 22, with an outer peripheral portion of the blank 24 being gripped by and between the die 20 and the pressure ring 22. In this case, the forming load F for pressing the blank 24 is represented by the formula (1) indicated below. In this formula (1), $P_0$ is a force (shrinking force) needed to draw a flange portion of the blank 24 in the radial direction, $\Delta P_H$ is a frictional force acting on the flange portion due to the blank-holding force, $\Delta P_{b1}$ and $\Delta P_{b2}$ are bending and spring-back forces, $\mu$ is a friction coefficient of blank-holding portions of the die 20 and pressure ring 22, and $\phi$ is an angle of contact of a corner portion of the die 20. A mere increase in the strength of the blank 24 leads to an increase in the fracture force of its side wall 28 which is prone to fracture. However, fractures cannot be avoided or are even worsened since the forming load F is increased with increases in the values $P_0$, $\Delta P_{b1}$ and $\Delta P_{b2}$. In the instant embodiment, only the side wall 28 and other stress-concentrated portions are locally strengthened, with almost no change in the forming load F, and the fracture force can therefore be increased at the side wall 28 and other portions, resulting in reduced fractures and improved formability. The fracture force $P_{cr}$ is represented by the following formula (2), which includes the tensile strength TS, and a function f(n, r) in which n-value and r-value are parameters. It will be understood that the fracture force $P_{cr}$ is increased as the tensile strength TS is increased by strengthening the stress-concentrated portions.

$$F=\exp(\mu\cdot\phi)\cdot(P_0+\Delta P_H+\Delta P_{b1})+\Delta P_{b2} \quad (1)$$

$$P_{cr}=TS\cdot f(n, r) \quad (2)$$

Four kinds of carbon steel plates as indicated in TABLE 1 below were subjected to deep cup drawing, in a test for determining the formability of these plates. In TABLE 1, TS is tensile strength (MPa), YP is yield strength (MPa), El is elongation (%) of a specimen as measured when it is

TABLE 1

Figure 3A:
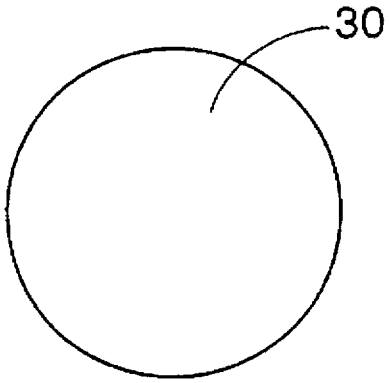
FIG. 3A is a view showing a pattern (I) which has no linearly strengthened portion formed in a blank.
Figure 3B:
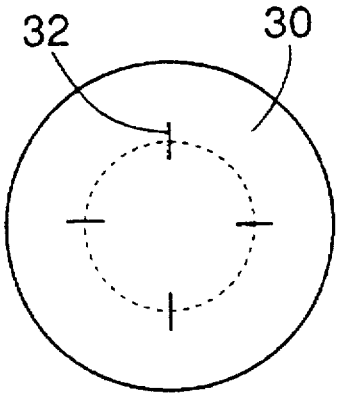
FIG. 3B is a view showing a pattern (II) of linearly strengthened portions formed in a blank.
Figure 3C:
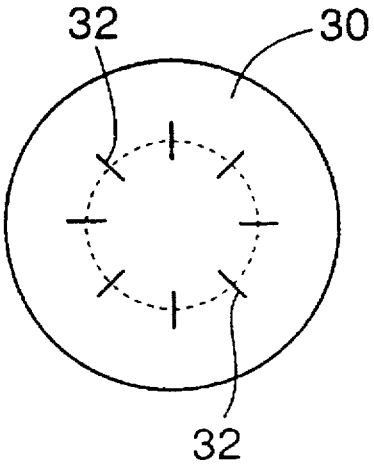
FIG. 3C is a view showing a pattern (III) of linearly strengthened portions formed in a blank.
Figure 3D:
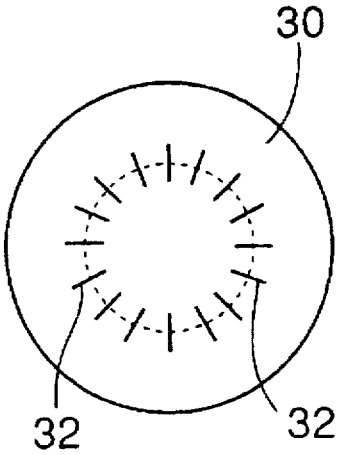
FIG. 3D is a view showing a pattern (IV) of linearly strengthened portions formed in a blank.

| | | TS | YP | El | n-value | r-value |
|---|---|---|---|---|---|---|
| Mild steel plate | SGACF | 304 | 147 | 48.8 | 0.235 | 1.98 |
| | SGACD | 350 | 241 | 42.2 | 0.223 | 1.30 |
| high-strength steel plate | SGAC340HR | 343 | 202 | 48.9 | 0.227 | 2.11 |
| | SGAC340 | 350 | 190 | 45.1 | 0.232 | 1.96 |

broken, n-value is strain hardening exponent, and r-value is Lankford value. Mild steel plates SGACF, SGACD had a thickness of 0.7 mm, and high-strength steel plates SGAC340HR, SGAC340 had a thickness of 0.8 mm. While all of the four kinds of carbon steel plates are generally used as blanks to be pressed into automobile components, the mild steel plate SGACF and high-strength steel plate SGAC340HR are high-grade materials which are not likely to have fractures, and the mild steel plate SGACD and high-strength steel plate SGAC 340 are low-grade materials which are likely to have fractures. In the test, a 200 mm-diameter blank formed from each steel plate was deeply drawn, using a 100 mm-diameter punch. Each of linearly strengthened portions was formed through structural transformation of the blank material, by irradiating a local point or spot on the blank with a laser beam, and moving the laser beam at a rate of 3 m/min., along a desired line. The focal point of the laser beam was spaced −1 mm from the surface of the blank, that is, the distance between the focal point and the blank surface receiving the laser beam was 1 mm. Since the thickness of the steel plate or blank was 0.7 mm or 0.8 mm, the focal point was spaced 0.3 or 0.2 mm from the rear surface of the blank opposite to the beam-receiving surface. The power of the laser beam was 3 kW. The pattern of irradiation of the laser beam, that is, the pattern of linearly strengthened portions was selected from four patterns (I) through (IV) as shown in FIGS. 3A–3D. In the pattern (I), the blank 30 had no linear strengthened portion, that is, a 200 mm-diameter blank was merely subjected to a deep drawing operation. In the patterns (II), (III) and (IV), the blanks 30 had four, eight and sixteen linearly strengthened portions 32, respectively. These strengthened portions 32 of each pattern (II)–(IV) were equiangularly spaced from each other, and had a length of 40 mm. In FIGS. 3B–3D, a 100 mm-diameter circle indicated by a dot line represents a portion of the blank which is bent by a punch shoulder during drawing. The linearly strengthened portions 32 extended 20 mm radially outwards and inwards from this circle.

Figure 2:
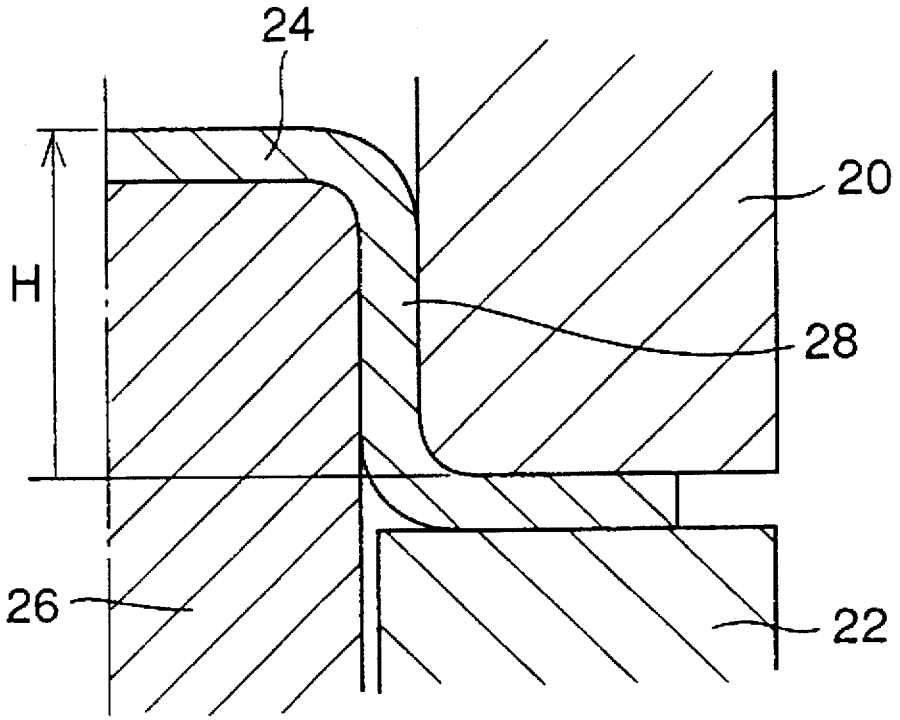
FIG. 2 is a cross sectional view showing a blank and a press used for cupping or cup drawing.
Figure 4A:
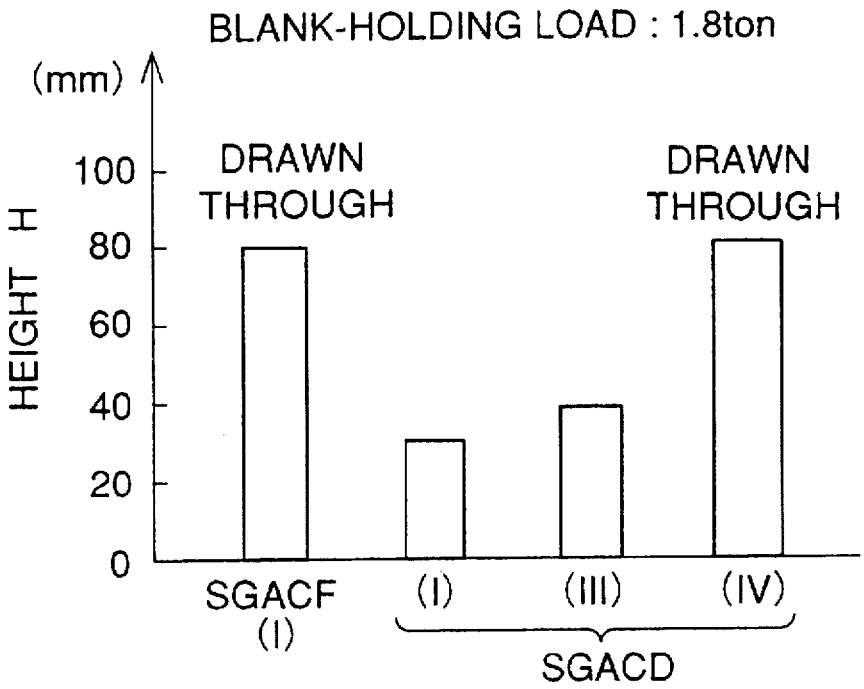
FIG. 4A is a graph showing the heights of formed pieces formed by drawing, using blanks having the patterns (I), (III) and (iV) of FIGS. 3A, 3C and 3D.
Figure 4B:
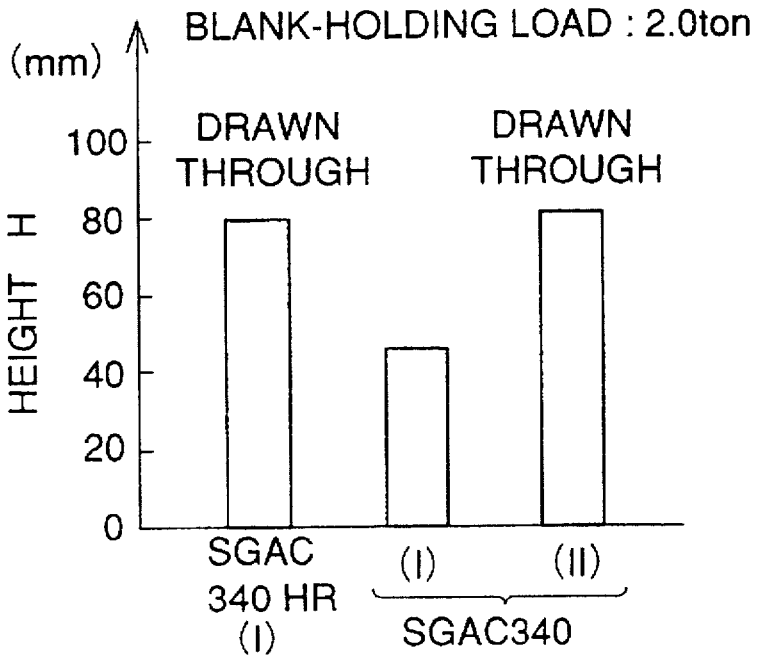
FIG. 4B is a graph showing the heights of formed pieces formed by drawing, using blanks having the patterns (I), (II) of FIGS. 3A and 3B.

The graphs of FIGS. 4A and 4B indicate the results of the deep drawing test as described above. In these graphs, (I)–(IV) represent the irradiation patterns (I)–(IV) as shown in FIGS. 3A–3D. In the drawing test for the mild steel plates SGACF and SGACD, as indicated in FIG. 4A, the blank-holding load of 1.8 ton was employed, which was the maximum load with which the high-grade material SGACF with no strengthened portion (I) could be completely drawn, that is, drawn through to form a cup-shaped piece with no flange. When some specimens of the low-grade material SGACD were drawn with the blank-holding load of 1.8 ton, a specimen with no linearly strengthened portion (I) and a specimen with eight linearly strengthened portions (III) were broken or ruptured at their portions corresponding to the punch shoulder, before the height H (FIG. 2) of the drawn part reached 40 mm. A specimen SGACD having sixteen linearly strengthened portions 32 (IV) was drawn through, without suffering from any fractures. This means that the low-grade material SGACD having the pattern (IV) has substantially the same degree of formability as the high-grade material SGACF. In the pattern (IV), adjacent ones of the sixteen strengthened portions 32 were spaced about 2 mm from each other. It is also understood from the graph of FIG. 4B showing the results of the drawing test on the high-strength steel plates that the low-grade material SGAC340 having four linearly strengthened portions (II) has substantially the same degree of formability as the high-grade material SGAC340HR. The blank 24 as shown in FIG. 2 is considered to be completely drawn or drawn through, when a cup-shaped article is formed, with no flange left between the die 20 and the pressure ring 22 at the outer periphery of the blank 24.

There will be described another embodiment of the present invention.

Figure 5A:
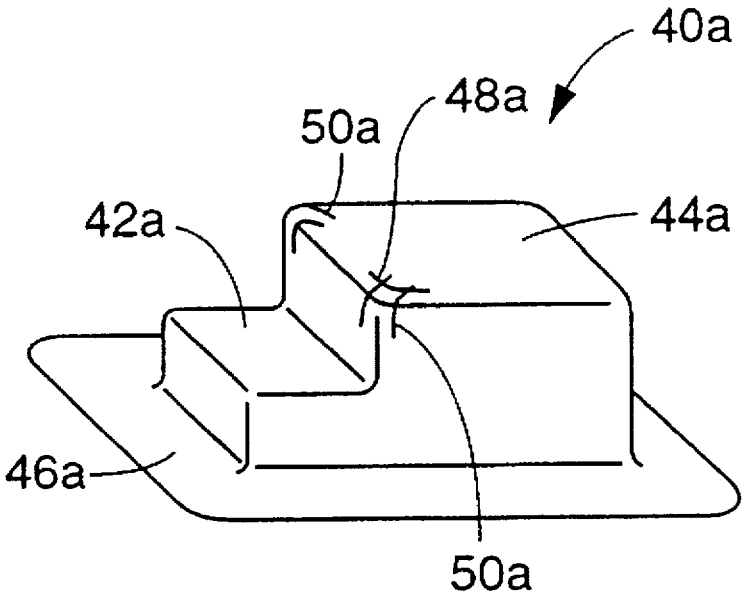
FIG. 5A is a perspective view showing an example of a formed piece produced by a press working method according to another aspect of the present invention.
Figure 5B:
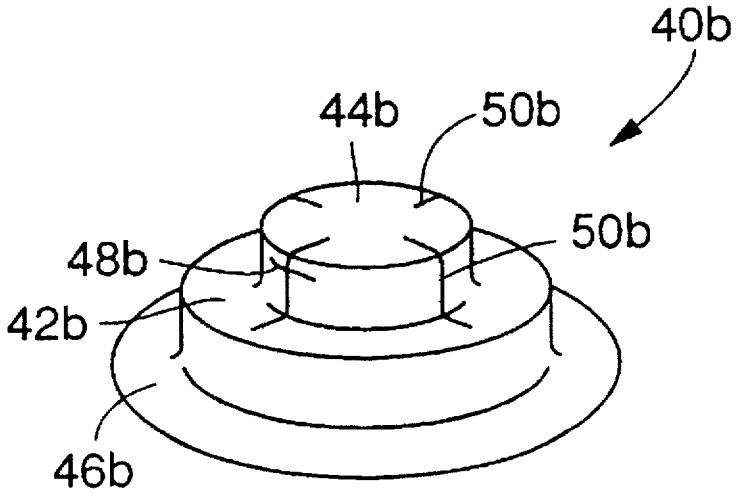
FIG. 5B is a perspective view showing another example of a formed piece produced by the above method of the present invention.

Referring to FIGS. 5A and 5B, formed pieces **40*a*, 40*b* have plural steps of drawn parts or protrusions, that is, first drawn parts 42*a*, 42*b*, and second drawn parts 44*a*, 44*b* formed on the first drawn parts 42*a*, 42*b*. It is difficult to control the inward movement distance or amount of material flow of the blank relative to the pressure member, for forming the second drawn parts 44*a*, 44*b*, by controlling the blank-holding force applied to flange portions 46*a*, 46*b* of respective blanks. Further, the material is hard to flow or move inwardly relative to the pressure member to form the second drawn parts 44*a*, 44*b*. Therefore, the second drawn parts 44*a*, 44*b* tend to have fractures 48*a*, 48*b* at its portions corresponding to the shoulder of the punch used for drawing these parts 44*a*, 44*b*. Namely, the second drawn parts 44*a*, 44*b* are formed by bulging, and may be called bulged portions. In this embodiment, the second drawn parts 44*a*, 44*b* are locally strengthened by the structural transformation of the blank material as in the first embodiment, to provide linearly strengthened portions 50*a*, 50*b* prior to the drawing or bulging operation. The linearly strengthened portions 50*a*, 50*b* are formed in a direction substantially parallel to the direction in which the tension acts on the respective drawn parts 44*a*, 44*b* during the drawing operation. The formed piece 40*a* is a stepped rectangular article formed by rectangular drawing, and is provided with two linearly strengthened portions 50*a* corresponding to each of two corners of the second drawn part 44*a* on the side of the first drawn part 42*a*. These strengthened portions 50*a* extend substantially in parallel with the vertical axis of the rectangular article. The formed piece 40*b* is a two-stage cylindrical article formed by drawing, and has four linearly strengthened portions 50*a*** which are spaced equiangularly from each other and are substantially parallel with the axis of the cylindrical article.

As described above, the peripheral portion of the blank material is hard to move or flow inwardly relative to the pressure member to form the bulged portions, i.e., the second drawn parts 44a, 44b, during the drawing operation. In the instant embodiment, the second drawn parts 44a, 44b are locally strengthened due to the structural transformation, assuring increased fracture force, which leads to reduced fractures, and improved formability due to an increased distance of the inward movement of the material. The movement distance of flow of the material increases with a degree of the structural transformation that occurs at the linearly strengthened portions 50a, 50b. Due to the increased fracture force, a blank to be bulged may be formed of a material whose grade is lower than a conventionally used material, with a result of reduction in the material cost. Further, the improved formability permits formation of pressed articles which cannot conventionally be formed by press working. Since the linearly strengthened portions 50a, 50b are formed substantially in parallel with the direction of the tension induced during the press working, the resistance to deformation is increased mainly in the direction of the tension, and a sufficiently large amount of the material can be drawn into the second drawn parts 44a, 44b, due to the increased tensile strength, without affecting deformation of these parts in the other directions.

Figure 6:
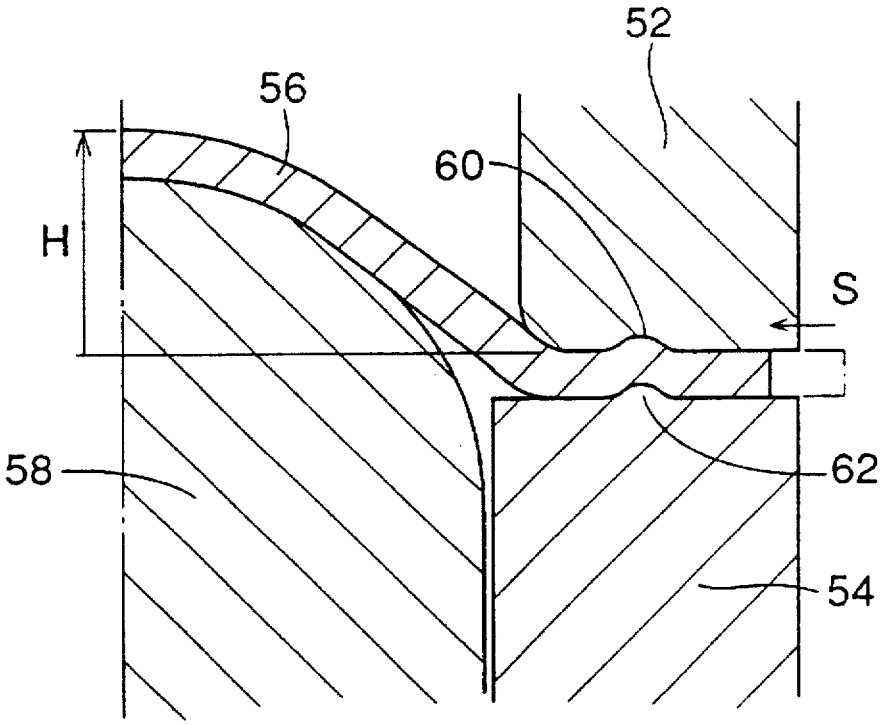
FIG. 6 is a cross sectional view showing a blank and a press used for a bulging operation on the blank.

When a blank 56 is subjected to a bulging operation, using a press as shown in FIG. 6, the blank 56 is gripped at its outer peripheral portion by and between a die 52 and a pressure ring 54, and a punch 58 having a spherical head is moved upwards relative to the die 52 and the pressure ring 54. Recess 60 and boss 62 are formed at corresponding surface areas of the die 52 and the pressure ring 54, so as to prevent flow or inward movement of the material relative to the die 52 and pressure ring 54. While the height H of a piece formed by the bulging operation is determined by elongation of the material, the height H also increases with the inward movement distance S. When the press as shown in FIG. 6 is used, therefore, the height H of the formed piece can be increased as the movement distance S of the material is increased by reducing the blank-holding load or reducing the size of the bosses 62. In the case of the formed pieces 40a, 40b having stepped drawn parts, however, it is difficult to change the heights of the second drawn parts 44a, 44b, by controlling the blank-holding load, or the amount of flow or movement distance of the material at the flange portions 46a, 46b by means of bosses. In this case, the movement distance of the material can be effectively controlled by the linearly strengthened portions 50a, 50b as described above. Such linearly strengthened portions may also be provided on the blank 56 before it is bulged by the press as shown in FIG. 6, so as to control the inward movement distance of the material.

Figure 7:
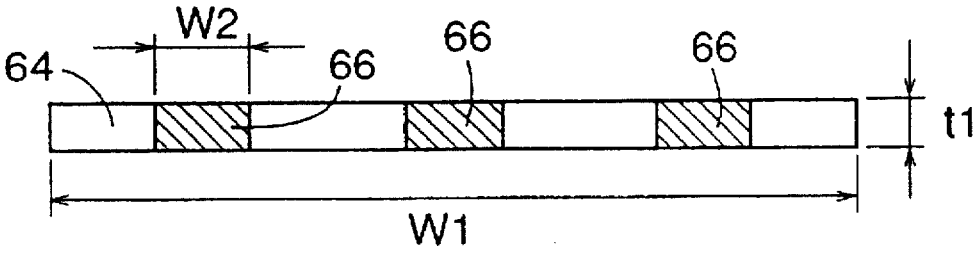
FIG. 7 is a view for explaining increased tensile strength of a blank due to its structural transformation.

The provision of the linearly strengthened portions 50a, 50b leads to increased tensile strength, as explained below. FIG. 7 shows a blank 64 which has a width W1, a thickness t1 and a tensile strength TS1. The width W1 is measured in a direction perpendicular to the direction of the tension that is perpendicular to the plane of the view in FIG. 7. When the blank 64 is provided with three linearly strengthened portions 66 having a width W2 and a tensile strength TS2, the resulting tensile strength $TS_T$ is represented by the formula (3) as indicated below. For example, when TS1, TS2, W1 and W2 are equal to 28 kgf/mm$^2$, 120 kgf/mm$^2$, 25 mm and 2 mm, respectively, the tensile strength $TS_T$ will be approximately 50 kgf/mm$^2$. The thus increased tensile strength leads to an increase in the inward movement distance or amount of flow of the material for forming a bulged part. It is to be noted that 1 kgf/mm$^2$ is approximately 9.8 MPa.

$$TS_T=\{TS1\cdot(W1-3W2)+3\cdot TS2\cdot W2\}/W1 \quad (3)$$

Figure 8A:
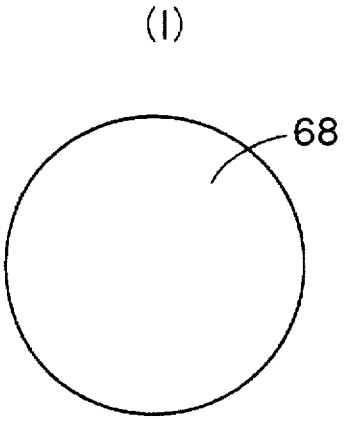
FIG. 8A is a view showing a pattern (I) which has no linearly strengthened portion formed in a blank.
Figure 8B:
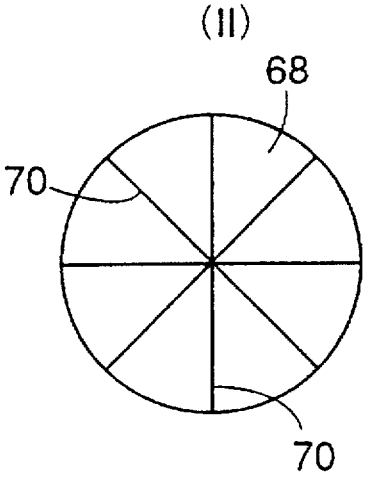
FIG. 8B is a line showing a pattern (II) of linearly strengthened portions formed in a blank.
Figure 9A:
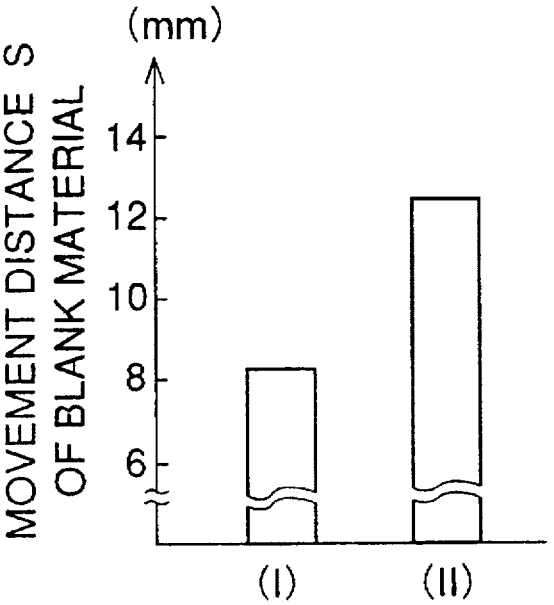
FIG. 9A is a graph showing an inward movement distance S of a blank material corresponding to each of the patterns (I) and (II) of FIGS. 8A and 8B.
Figure 9B:
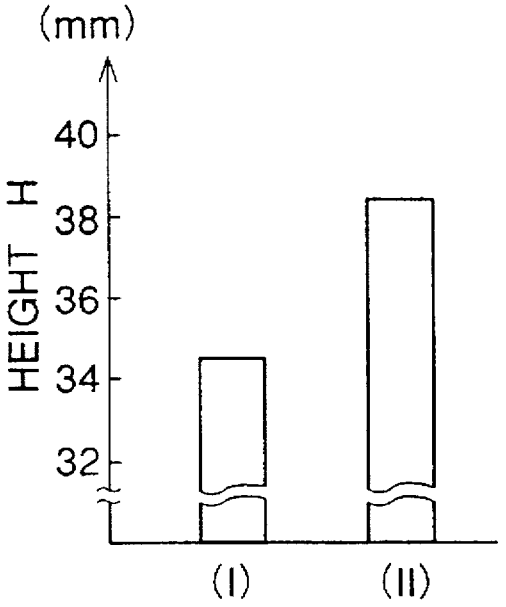
FIG. 9B is a graph showing a height H of a formed piece corresponding to each of the patterns (I) and (II) of FIGS. 8A and 8B.

Two specimens of the mild steel plate SGACF as indicated in TABLE 1 were subjected to a bulging operation, using a press having a punch with a spherical head as shown in FIG. 6, and the movement distance S of the material of each blank and the height H of the formed piece were measured. The spherical head of the punch had a diameter of 100 m, and the blank formed from the steel sheet had a diameter of 200 mm. The laser beam used for forming linearly strengthened portions traveled along these portions at a rate of 3 m/min., and the focal point was spaced −1 mm from the blank surface receiving the laser beam. The power of the laser beam was 3 kW. The two specimens had respective irradiation patterns (I) and (II) as shown in FIGS. 8A and 8B. In the pattern (I), the 200 mm-diameter blank 68 had no linearly strengthened portion, and was directly pressed to form a bulged part. In the pattern (II), four linearly strengthened portions 70 were formed such that the portions 70 are equiangularly spaced apart from each other. The graphs of FIG. 9A and FIG. 9B indicate the results of measurement of the movement distance S of the material, and the height H of the formed piece, which were measured until fractures were formed. It will be understood from the movement distance S and the height H are both significantly increased by providing the strengthened portions 90. If the term "bulging" is interpreted to mean that the outer peripheral portion of the blank 68 is completely inhibited from moving inwardly of the die 52 and pressure ring 54, thus making the movement distance S zero, the above press working cannot be called "bulging" in a strict sense since the peripheral portion flows or moves inwardly by the distance S. However, if the second drawn parts 44a, 44b of the formed pieces 40a, 40b are locally strengthened as shown in FIG. 5, the fracture force is increased at the linearly strengthened portions 50a, 50b, with a result of an increased distance of movement of the material for forming the drawn parts 44a, 44b. Thus, the form of press working effected on the second drawn parts 44a, 44b is changed from bulging to drawing, due to the increased movement distance of the material, whereby fractures are less likely to be formed in these parts 44a, 44b.

Figure 10A:
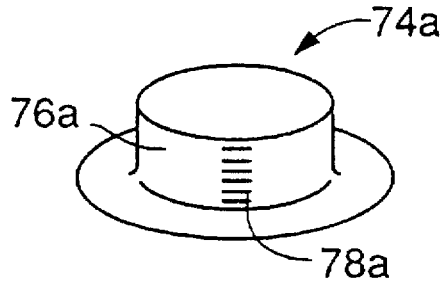
FIG. 10A through FIG. 10C are perspective views showing examples of a formed piece produced by a press working method according to a further aspect of the present invention.
Figure 10B:
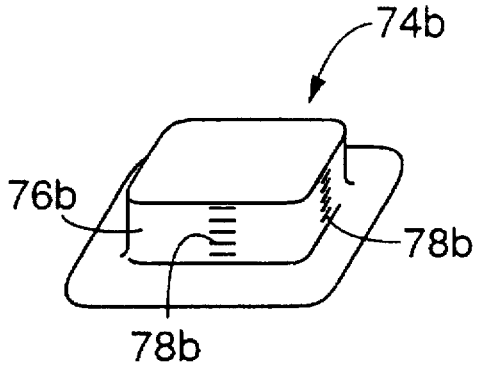
Figure 10C:
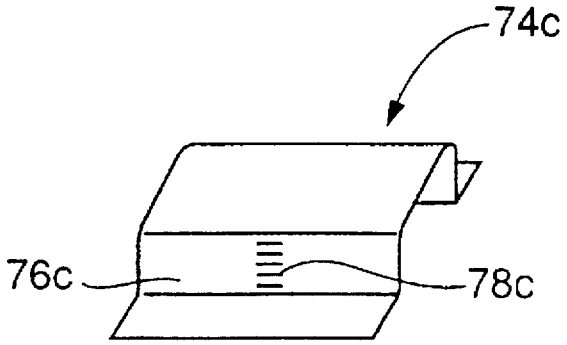
Figure 11A:
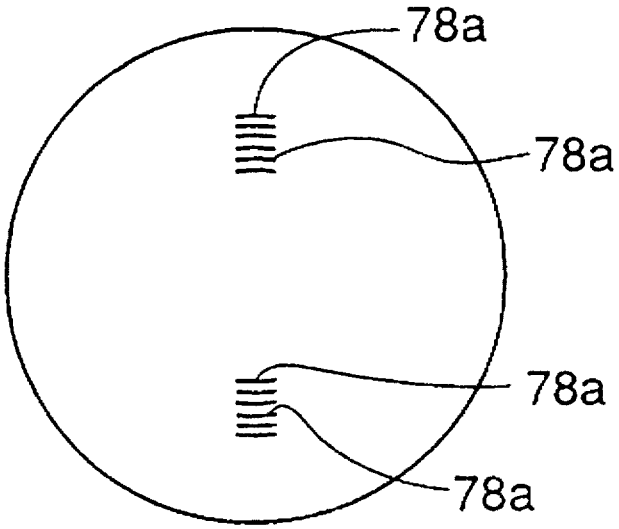
FIG. 11A is a plan view of a blank which gives the formed piece of FIG. 10A after press working.
Figure 11B:
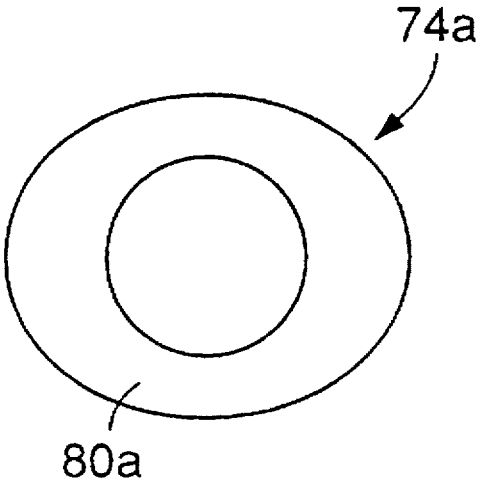
FIG. 11B is a plan view of the formed piece of FIG. 10A.

Referring next to FIG. 10A, a formed piece 74a is formed by pressing a central portion of a blank against a punch having a circular cross section, while the blank is gripped at its outer peripheral portion by a die and a pressure ring. As shown in FIG. 10B, a formed piece 74b is formed by pressing a central portion of a blank against a punch having a rectangular cross section, while the blank is gripped at its outer peripheral portion. As shown in FIG. 10C, a formed piece 74c having a hat-like shape is formed by bending a middle portion of a rectangular blank against a punch having a rectangular cross section, while the blank is gripped at its opposite end portions. These formed pieces 74a–74c are provided at their side walls 76a–76c with linearly strengthened portions 78a–78c, which are formed by the structural transformation of the blank material prior to the press working as described above. While the side walls 76a–76c are elongated during the press working, the linearly strengthened portions 78a–78c have a relatively high tensile strength, which results in a reduced amount of elongation and an increased distance of inward movement of the material at the peripheral portions, as compared with the other portions of the side walls 76a–76c. To provide the formed piece 74a, for example, a circular blank as shown in FIG. 11A is subjected to cup drawing. Since the amount of elongation of the linearly strengthened portions 78a are relatively small, with an increased movement distance of the material at the peripheral portion, the formed piece 74a has an elliptic flange portion 80a as shown in the plan view of FIG. 11B. It is to be understood that the shape of the blank to be pressed may be determined so that the flange portion 80a has a circular shape, taking account of the movement distance of the material at different portions of the side wall 76a, that is, the linearly strengthened portions 78a and the other portions.

Figures 12, 13:
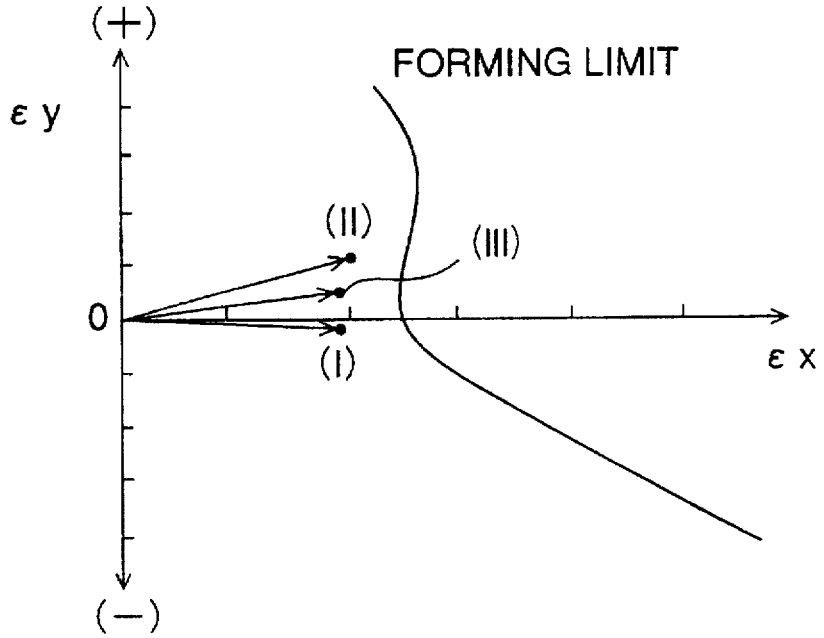
FIG. 12 is a table showing changes of the shapes of the blank before and after various types of deformation.
FIG. 13 is a graph showing the relationship between the type of deformation and the amount of strain up to the forming limit.

The side walls 76a–76c having the linearly strengthened portions 78a–78c are drawn while being distorted as a whole, since the amount of elongation is different from portion to portion, as described above. Thus, the form of deformation of the side walls 76a–76c varies from that of a side wall having no linearly strengthened portion. The types of deformation of a blank during press working may be defined by the relationship between a strain $\epsilon x$ in the direction of x-axis in which the tension acts on the blank, and a strain $\epsilon y$ in the direction of y-axis which is perpendicular to the direction of the tension, in a two-dimensional coordinate system in the plane of the blank. As shown in FIG. 12, the types of deformation include: biaxial deformation in which the strain $\epsilon y$ in the y-axis direction is substantially equal to the strain $\epsilon x$ in the x-axis direction; plane strain deformation in which the strain $\epsilon y$ is approximately zero; and uniaxial deformation in which the strain $\epsilon y$ is a negative value. When the blank undergoes the plane strain deformation in which the strain $\epsilon y$ in the y-axis direction is substantially zero, the amount of strain at the forming limit at which fractures are formed has the smallest value, that is, $\sqrt{(\epsilon x^2+\epsilon y^2)}$, as shown in the graph of FIG. 13. Accordingly, the linearly strengthened portions 78a–78c are provided in a suitable form so as to increase the tensile strength in a particular direction, so that the plane strain deformation is changed to the biaxial or uniaxial deformation, for example. In this manner, the amount of strain at the forming limit can be increased, thus preventing occurrence of fractures. This permits the use of a lower-grade material for the blank, which leads to a reduced material cost, and makes it possible to form such articles that cannot be conventionally formed by press working.

The linearly strengthened portions 78a–78c have a relatively short length in a range of several millimeters to several tens of millimeters. For each of the formed pieces 74a–74c, a relatively large number of linearly strengthened portions 78a–78c are formed in a direction substantially perpendicular to the direction in which the tension acts on the blank during the press working, such that these portions 78a–78c are spaced a suitable distance from each other in the direction of the tension. In this case, the side walls 76a–76c are elongated to some extent in the direction of the tension, resulting in reduced fractures, as compared with the case where the strengthened portions are formed in parallel with the tension, thereby to reduce the amount of elongation in that direction.

Figure 14A:
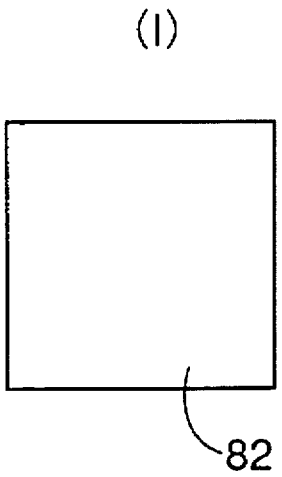
FIG. 14A is a view showing a pattern (I) which has no linearly strengthened portion formed in a blank.
Figure 14B:
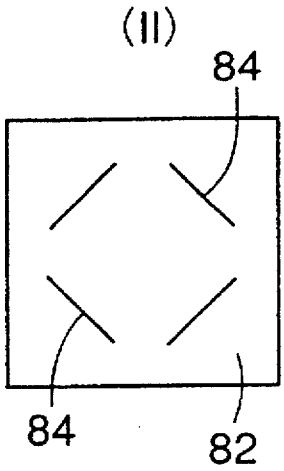
FIG. 14B is a view showing a pattern (II) of linearly strengthened portions formed in a blank.
Figure 14C:
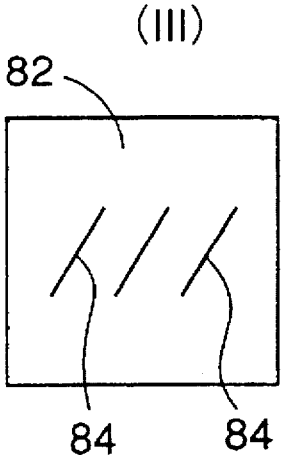
FIG. 14C is a view showing a pattern (III) of linearly strengthened portions formed in a blank.
Figure 15:
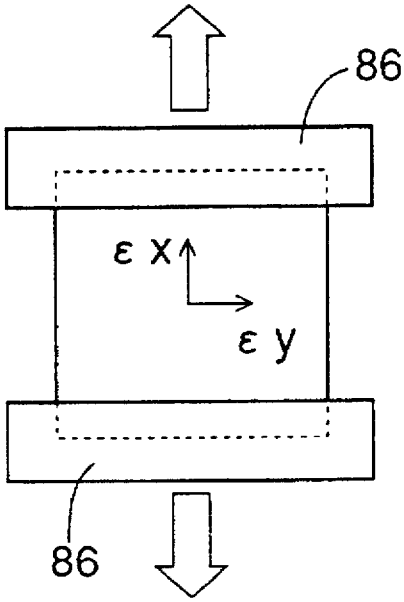
FIG. 15 is a view showing a chuck used in a tensile strength test conducted on blanks having the patterns of FIGS. 14A–14C.

To observe changes in the type of deformation by a scribed circle test, a tensile test was conducted on three specimens of the mild steel plate SGACF as indicated in TABLE 1. Each specimen was a square blank of 250 mm×250 mm size. The laser beam for forming the linearly strengthened portions was moved along these portions at a rate of 3 m/min., and the focal point was spaced −1 mm from the surface of the specimen that receives the laser beam. The power of the laser beam was 3 kW. The three specimens had respective irradiation patterns (I), (II) and (III) as shown in FIGS. 14A–14C. In the pattern (I), the square blank 82 had no linearly strengthened portion, and was directly subjected to the tensile test. The pattern (II) had four linearly strengthened portions 84 which correspond to four corners of the square blank 82. In the pattern (III), three inclined lines were formed as linearly strengthened portions 84 in a central portion of the blank 82. In the tensile strength test, the upper and lower sides of each specimen 82 were gripped by and between a pair of relatively wide chucking members 86, as shown in FIG. 15, and the chucking members 86 were pulled upwards and downwards with a predetermined tension so as to cause plastic deformation of the specimen 82. Then, the x-axis strain $\epsilon x$ and the y-axis strain $\epsilon y$ were measured at the central portion of each specimen 82. The results of the measurement with respect to the respective patterns (I), (II) and (III) are shown in the graph of FIG. 13. It will be understood from the results that the type of deformation of a blank during press working is changed by locally strengthening the blank.

Figure 16A:
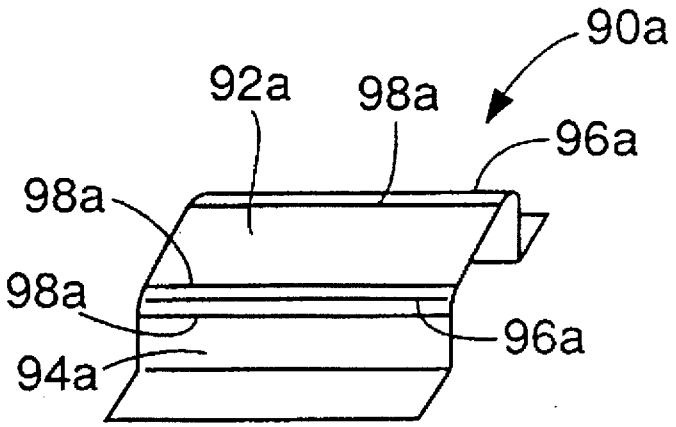
FIG. 16A is a perspective view showing an example of a formed piece produced by a press working method according to a still further aspect of the present invention.
Figure 16B:
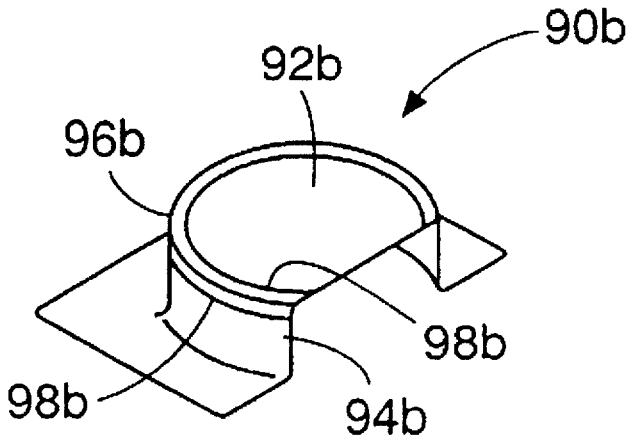
FIG. 16B is a perspective view showing another example of a formed piece produced by the above method of the present invention.
Figure 18A:
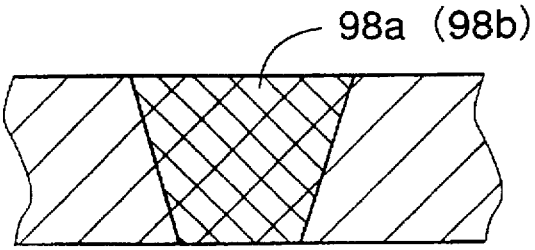
FIG. 18A is a cross sectional view showing an example of a linearly strengthened portion of the formed piece of FIG. 16A or 16B, which is formed by irradiation of a high energy density beam.
Figure 18B:
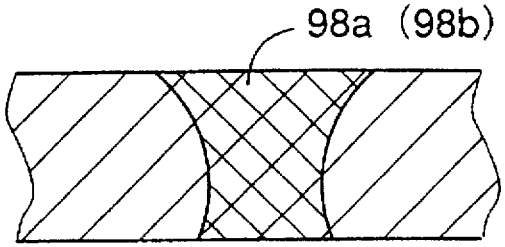
FIG. 18B is a cross sectional view showing another example of a linearly strengthened portion of the formed piece of FIG. 16A or 16B.
Figure 18C:
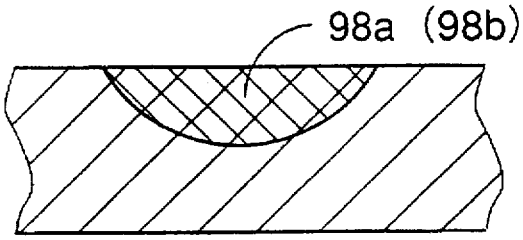
FIG. 18C is a cross section view showing a further example of a linearly strengthened portion of the formed piece of FIG. 16A or 16B.
Figure 19:
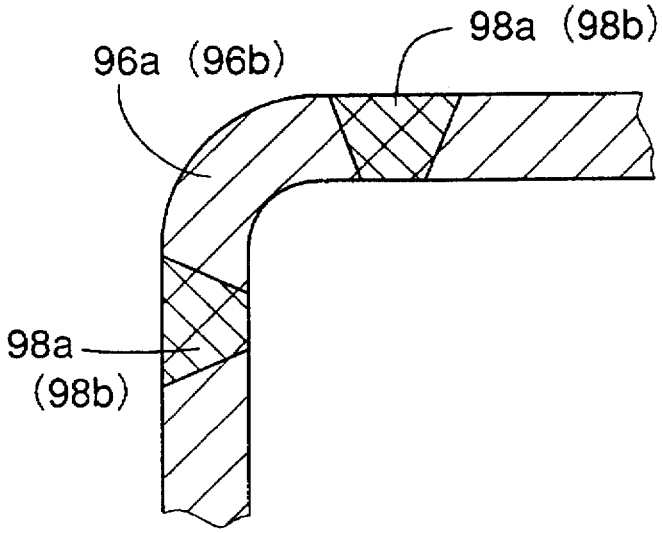
FIG. 19 is a view showing a bend formed on the formed piece of FIG. 16A or 16B, and two linearly strengthened portions.

Referring next to FIGS. 16A and 16B, a formed piece 90a is formed by bending a rectangular blank into a hat-like shape, and a formed piece 90b is formed by cup drawing, with a side portion removed. The formed pieces 90a, 90b are provided at their upper surfaces 92a, 92b and side walls 94a, 94b with linearly strengthened portions 98a, 98b, which extend substantially in parallel with each bend 96a, 96b of the formed pieces 90a, 90b which is bent at an angle of about 90°. To obtain the formed piece 90a, for example, a metal sheet as the blank is pressed against a punch 104, and the punch 104 is moved upwards while the blank is gripped at its opposite end portions by a die 100 and a pressure ring 102, as shown in FIG. 17, so as to bend the blank by the punch shoulders. The linearly strengthened portions 98a, 98b are formed by the structural transformation of blank materials as described above, before the press working is effected. More specifically, a high energy density beam, such as a laser beam, is applied to appropriate portions of each blank on the outer side of the bends 96a, 96b. With the structural transformation occurring at the irradiated portions of the blank which extend in parallel with the bends 96a, 96b, compressive stresses develop at the irradiated portions on the outer side of the bends 96a, 96b, due to the volume expansion of these portions caused by the structural transformation. FIGS. 18A–18C show in cross section three examples (a)–(c) of the linearly strengthened portions 98a, 98b, which are formed by irradiating the upper surfaces of respective blanks with a high energy density beam. The strengthened portions 98a (98b) of the examples of FIGS. 18A and 18B are formed by completely hardening the blanks through the entire thickness thereof, such that the fused portions reach the rear surfaces of the blanks. The strengthened portion 98a (98b) of the example of FIG. 18C is formed by incompletely hardening the blank such that the fused portion does not reach the rear surface of the blank. In either case, a relatively large area of the upper surface of the blank receives the high energy density beam and undergoes the structural transformation, whereby relatively large compressive stresses due to the volume expansion are induced on the side of the upper surface of the blank, that is, on the outer side of a bend formed by bending the blank as described above. Upon formation of the bend, on the other hand, tensile stresses are induced on the outer side of the bend while compressive stresses arise on the inner side of the bend, resulting in springback of the formed piece due to these stresses. With the strengthened portions formed as described above, the tensile stresses caused by bending deformation are cancelled by the compressive residual stresses due to the structural transformation as described above, which remain in the vicinity of the bend. This results in reduced springback and improved dimensional accuracy of the formed piece. FIG. 19 is an enlarged cross sectional view showing the bend 96a (96b) formed by press working, and its adjacent portions, including the linearly strengthened portions 98a (98b) that are located at the opposite ends of the curvature of the bend 96a (96b). While the bends 96a, 96b of the formed pieces 90a, 90b are formed by press working while the blanks are subjected to a tension in the press as shown in FIG. 17, the same effects as described above may be achieved when a simple bending operation is effected.

Figure 20:
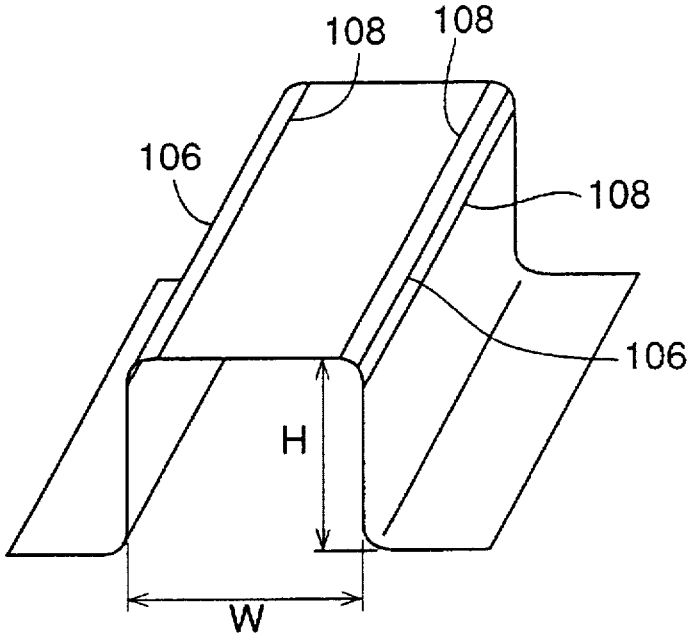
FIG. 20 is a view for explaining the shape of each specimen used in a test for determining the formability of a blank having linearly strengthened portions.
Figure 21:
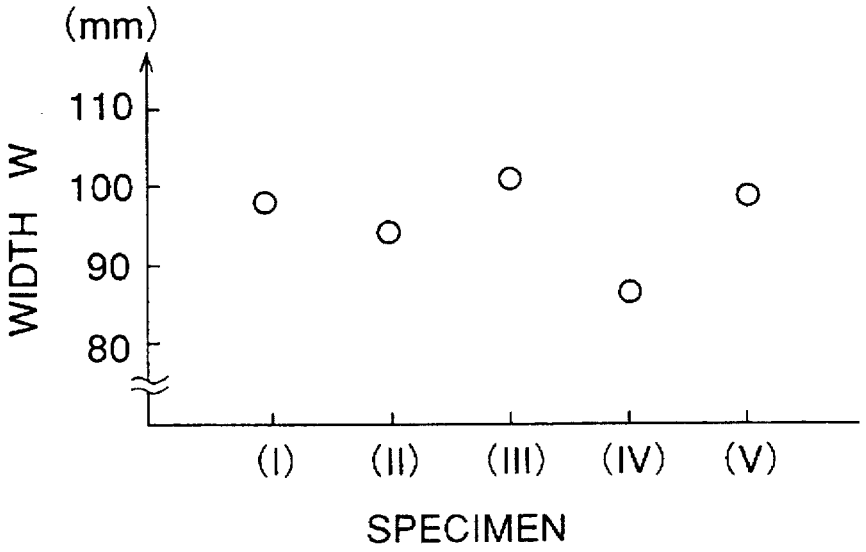
FIG. 21 is a graph showing the widths of the specimens (I) through (V) having the shape as shown in FIG. 20.

Five specimens (I)–(V) of carbon steel plate SGAC 440 having the tensile strength TS of 462 MPa, yield strength YP of 311 MPa, and elongation E1 of 32.0% were prepared, to check if the springback occurred after each specimen was subjected to a bending operation using a press as shown in FIG. 17. Each specimen had a size of 300 mm×300 mm and a thickness of 1.4 mm, and the press was designed such that the radius of curvature of the punch shoulder was 5 mm and the radius of curvature of the die shoulder was 8 mm. After the bending operation, each specimen had a shape as shown in FIG. 20, with a height H of 70 mm and a width W of 80 mm. The width W is a width dimension as measured at the lower end of the formed piece, when no springback occurred and two side walls extended in parallel with each other. The specimen (I) had no linearly strengthened portion, and four other specimens (II) through (V) had linearly strengthened portions 108 which were formed by a laser beam on the opposite sides of each bend 106. More specifically, the strengthened portions 108 were located at the opposite ends of the curvature of each bend 106, so as to extend in parallel with the bend 106. The linearly strengthened portions 108 of the respective specimens (II)–(V) were formed in different manners, as indicated in TABLE 2, in terms of whether complete or incomplete hardening occurred and whether the inner or outer surface of the bend was irradiated with the laser beam. The focal point of the laser beam was spaced −1 mm from the irradiated surface of the blank in the case of the complete hardening, and was spaced +4 mm from the same surface in the case of the incomplete hardening. The laser beam was moved along desired lines at a rate of 3 m/min., and the power of the laser beam was 3 kW. The graph of FIG. 21 shows the widths W of the respective specimens (I)–(V) as measured after the press working. It will be understood from the results that the specimens (II) and (IV) which received the laser beam from the outer side of their bends, particularly, the specimen (IV) having incompletely hardened portions, suffered from reduced springback.

TABLE 2

| Specimen | (I) | (II) | (III) | (IV) | (V) |
|---|---|---|---|---|---|
| Process of Strengthening | none | complete hardening | | incomplete hardening | |
| Irradiated Surface | — | outside | inside | outside | inside |

Figure 22:
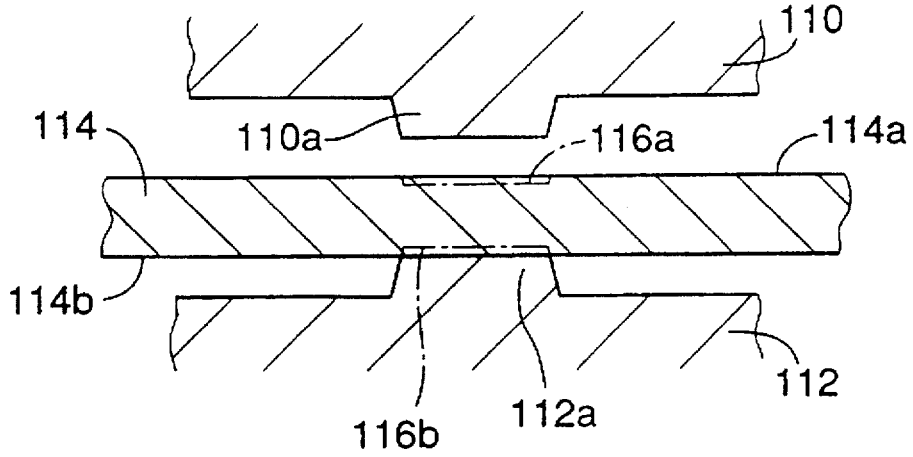
FIG. 22 is a cross sectional view showing one example of an embossing operation for forming strengthened portions.

In the illustrated embodiments of the present invention, the linearly strengthened portions are formed by structural transformation, by irradiating the portions with a high energy density beam. However, the strengthened portions may also be formed by coining or embossing. For example, an upper die 110 and a lower die 112 having respective protrusions 110a, 112a are used to effect an embossing operation on desired portions of a blank 114, as shown in FIG. 22, so that local portions of the opposite surfaces 114a, 114b of the blank 114 are subjected to compressive deformation, to thus form embossed portions 116a, 116b as indicated by one-dot chain lines in FIG. 22. The hardening of the material at the embossed portions 116a, 116b leads to improved mechanical strength, such as tensile strength, of the blank 114. The embossed portions 116a, 116b may be formed when the blank 114 is pressed into a desired shape, for example. The upper and lower dies 110, 112 as shown in FIG. 22 have respective protrusions 110a, 112a which are pressed against the opposite surfaces 114a, 114b of the blank 114, to form the embossed portions 116a, 116b. However, one of the two protrusions 110a, 112a may be eliminated, and only one embossed portion 116a, 116b may be formed on the corresponding surface 114a, 114b. In the fourth embodiment as shown in FIG. 16, such embossed portions are formed only in the surface of the blank which will be on the outer side of the bends 96a after the bending operation, and thus serve to reduce springback of the formed piece 90a.

Figure 23:
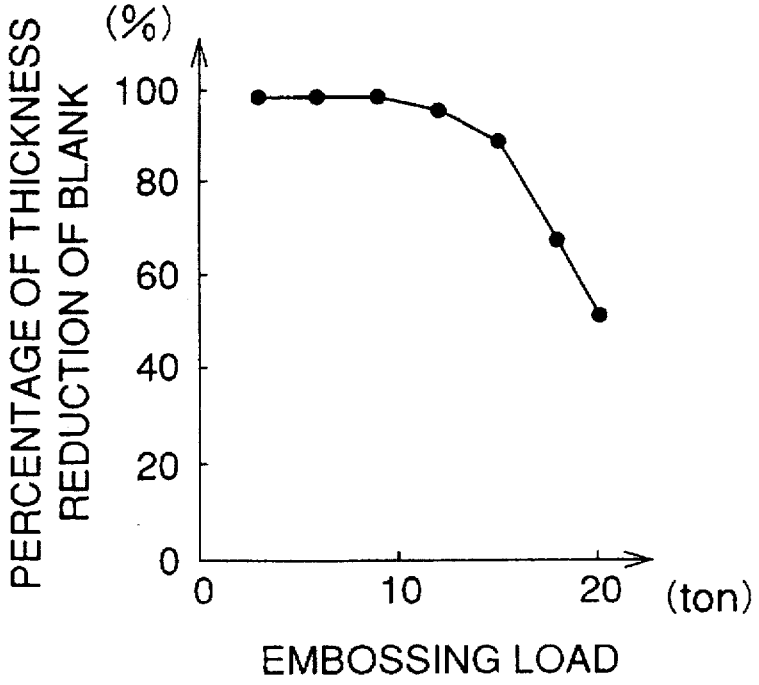
FIG. 23 is a graph showing the relationship between the embossing load and the percentage of thickness reduction of a blank.
Figure 24:
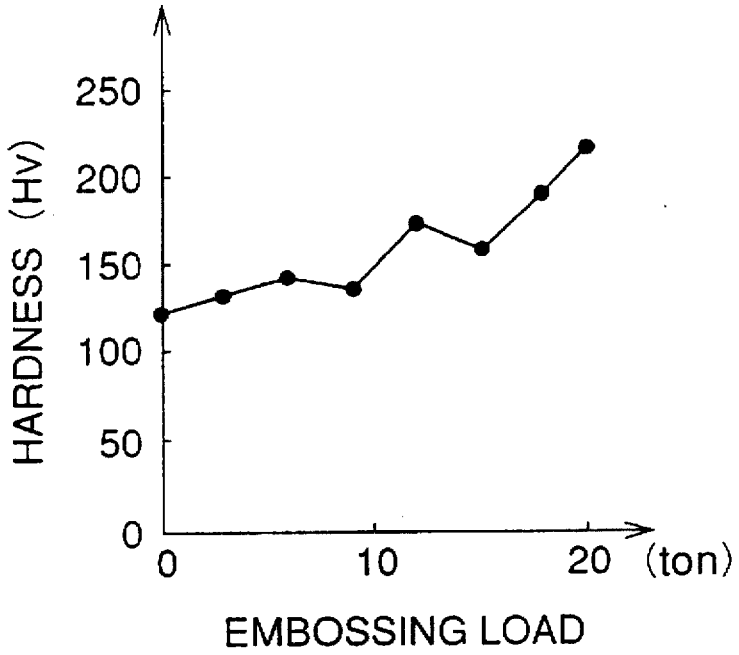
FIG. 24 is a graph showing the relationship between the embossing load and the hardness of a blank.
Figure 25:
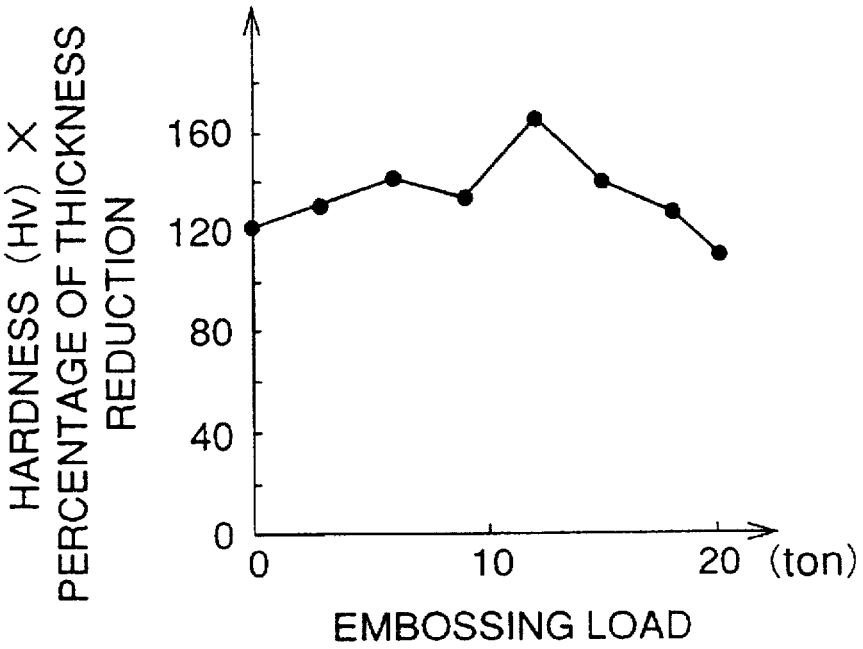
FIG. 25 is a graph showing the relationship between the embossing load and the product of the thickness reduction percentage and the hardness, which product corresponds to the fracture force of the blank.

The fracture force of a blank is proportional to the hardness and the tensile strength (stress) per unit cross sectional area, but inversely proportional to the cross sectional area of the blank. Therefore, the overall tensile strength TS of the blank is not necessarily increased even if the hardness and the tensile strength (stress) are increased at the embossed portions formed as described above. In this respect, the following test was conducted with respect to the mild steel plate SGACD as indicated in TABLE 1. In the test, embossed portions having a width of 4 mm and a length of 40 mm were formed on the opposite surfaces of the steel plate SGACD, with different embossing or stamping loads, using a press as shown in FIG. 22. The percentage (%) of thickness reduction of the blank and the hardness (Hv) of the blank were measured with respect to each embossing load, and the results of the measurements are indicated in the graphs of FIGS. 23 and 24. The percentage (%) of thickness reduction of the blank is represented by $(t-\Delta t)/t$, where t is the original blank thickness (about 0.7 mm in this case) and $\Delta t$ is the amount of thickness reduction caused by the embossing operation. As is apparent from FIGS. 23 and 24, the percentage (%) of thickness reduction of the blank is reduced with an increase in the embossing load, while the hardness (Hv) corresponding to the tensile strength (stress) is increased with an increase in the embossing load. The product of the hardness (Hv) and the percentage (%) of thickness reduction, as indicated in the graph of FIG. 25, corresponds to the actual tensile strength TS, and the fracture force of the blank. If the embossing operation is conducted with the embossing load which leads to the maximum value of the product of the hardness (Hv) and thickness reduction percentage, as seen in the graph of FIG. 25, the fracture force of the blank is effectively improved.

Figure 26A:
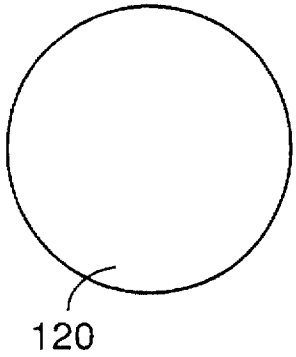
FIG. 26A is a view showing a pattern (I) which does not have any strengthened portion formed in a blank by an embossing operation.
Figure 26B:
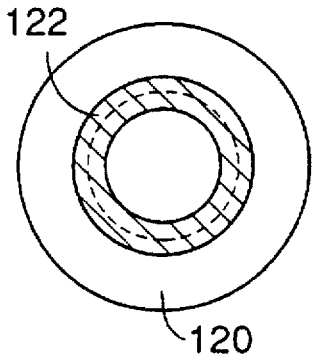
FIG. 26B is a view showing a pattern (II) of strengthened portions formed in a blank by an embossing operation.
Figure 26C:
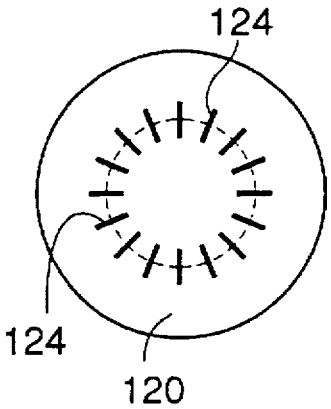
FIG. 26C is a view showing a pattern (III) of strengthened portions formed in a blank by an embossing operation.

To evaluate the formability, a deep cup drawing test was effected in the same manner as shown in FIGS. 3 and 4, with respect to some specimens prepared from the mild steel plates SGACF and SGACD as indicated in TABLE 1, using a punch having a diameter of 100 mm. The diameter of each specimen or blank 120 was 200 mm. Three patterns (I), (II) and (III) of strengthened portions as shown in FIGS. 26A–26C were employed in the drawing test. In the pattern (I), the 200 mm-diameter blank 120 included no strengthened portion, and was directly subjected to a deep drawing operation. In the pattern (II), the blank 120 was provided with a ring-shaped strengthened portion 122 having a width of 40 mm, as indicated as a hatched portion in FIG. 26. This strengthened portion 122 was formed in a portion of the blank 120 against which the punch shoulder was to be pressed. In the pattern (III), the blank 120 was provided with sixteen linearly strengthened portions 124 each having a width of 4 mm and a length of 40 mm, which were formed in a portion of the blank 120 against which the punch shoulder was to be pressed. The ring-shaped strengthened portion 122 and linearly strengthened portions 124 were formed by embossing or stamping appropriate portions of the opposite surfaces of the blank 120, at a pressure of about 50 kgf/mm$^2$. The linearly strengthened portions 124 extending in the radial directions were equiangularly spaced from each other. A dashed line as indicated in the patterns (II) and (III) indicates a 100 mm-diameter circle along which the punch shoulder was pressed against the blank 120 to form a bent portion. The ring-shaped strengthened portion 122 and linearly strengthened portions 124 extended radially inwards and outwards from the respective 100 mm-diameter circles, such that these strengthened portions 122, 124 were located within a 20 mm range of the circles in the radially opposite directions.

Figure 27:
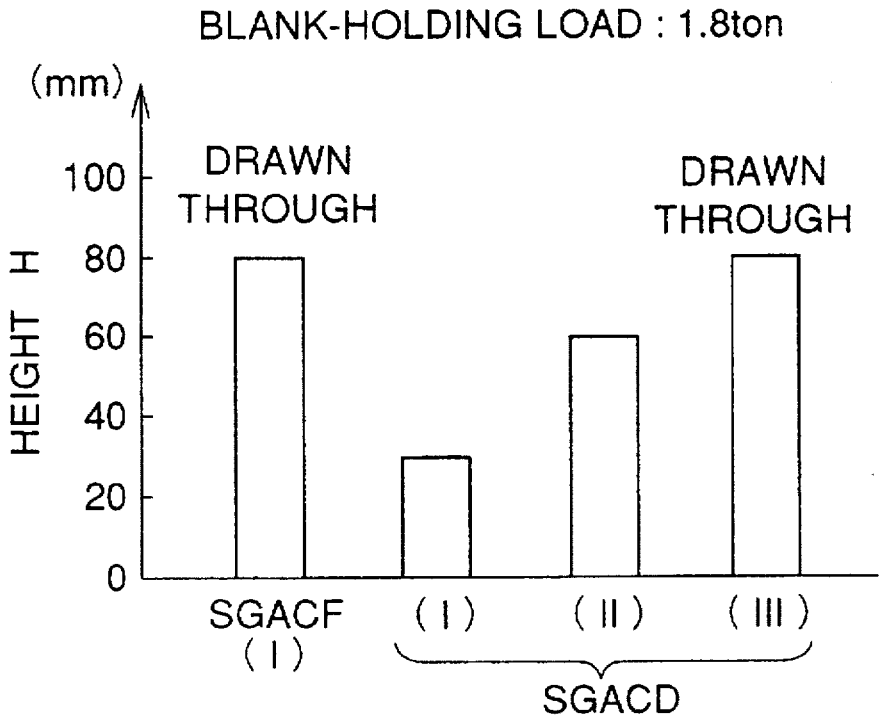
FIG. 27 is a graph showing the heights of formed pieces produced by drawing the blanks having the patterns (I)–(III) of FIGS. 26A–26C.

The results of the deep drawing test as described above are shown in the graph of FIG. 27, in which (I), (II) and (III) respectively indicate the patterns (I), (II) and (III) of the embossed portions as shown in FIG. 26. The blank-holding load of 1.8 ton was the maximum load with which the high-grade material SGACF with no strengthened portion (I) could be completely drawn, that is, drawn through to form a cup-shaped piece with no flange. When the low-grade material SGACD was used, fractures were formed near the punch shoulder when the blank 120 having the pattern (I) was drawn to a height H (FIG. 2) of about 30 mm, or when the blank 120 having the pattern (II) was drawn to a height H of about 60 mm. However, the blank 120 prepared from the same material SGACD could be drawn through without forming fractures, when the pattern (III) was employed, that is, when the sixteen linearly strengthened portions 124 were formed as shown in FIG. 26, assuring the same degree of formability as the high-grade material SGACF.

Figure 28:
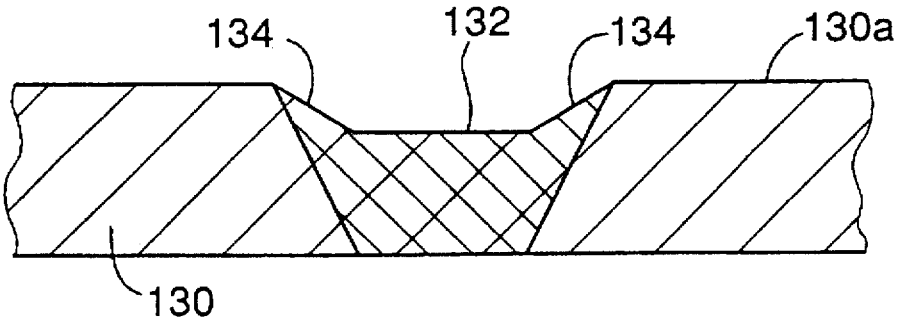
FIG. 28 is a cross sectional view showing an embossed portion of the blank which is formed by embossing in the vicinity of a bend, so as to prevent springback of the blank.

Referring to FIG. 28, a blank 130 has a linearly embossed portion 132, which is formed in the vicinity of a bend to be formed by press working, to extend in parallel with the bend. This; embossed portion 132 is formed in the surface 130*a* of the blank 130 on the outer side of the bend to be formed. As is apparent from FIG. 28 showing a cross section of the linearly embossed portion 132 in the plane substantially perpendicular to its longitudinal direction, the embossed portion 132 has opposite side walls 134 which are inclined such that the distance between the side walls increases from the bottom wall toward the opening of the portion 132. When the embossed portion 132 is formed, the cross-hatched section of the blank 130 in FIG. 28 undergoes compressive deformation. Since the thus deformed section is wider on the side of the surface 130*a* in which the embossed portion 132 is formed, compressive stresses remaining in this section prevent springback of the blank 130 when the blank 130 is subjected to the bending operation.

Figure 29:
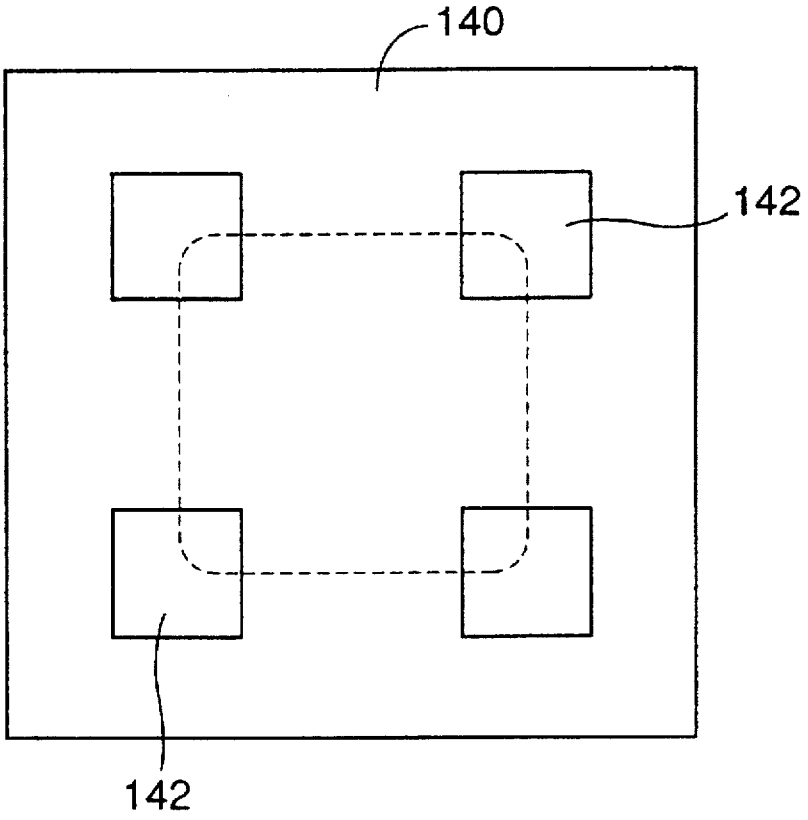
FIG. 29 is a view showing an example of embossing portions formed in a blank which is to be subjected to rectangular drawing.

Thus, the embossing operation provides the same effect as provided by the above-described process which utilizes structural transformation of the blank material. In addition, the thickness of the embossed portions is smaller than the other portions of the blank, whereby the blank-holding pressure is reduced, and the blank is less likely to be broken during the press working. In the case of the formed piece 10*c* as shown in FIG. 1, which is formed by rectangular drawing, fractures 14 are likely to be formed at corners connecting its side walls. If a blank 140 giving the formed piece 10*c* has embossed portions 142 which are formed on four corner portions of a profile of a punch as indicated by a dashed line in FIG. 29, such that parts of the portions 42 are held under a blank-holding pressure during press working, fractures are effectively avoided due to increased mechanical strength and reduced blank-holding pressure.

The above-described embossing operation can be advantageously employed when a steel sheet plated with fused zinc or other coated metal sheet is used as a blank, since desired local portions can be strengthened without evaporating the coating on the surface of the blank with the use of a high energy density beam. This embossing operation is also advantageously employed when a blank is made of such a material that exhibits increased mechanical strength due to its hardening or strain aging. Further, embossed portions may be formed by pressing a blank against a suitable mold, requiring a relatively low cost for installation and maintenance for effecting the embossing operation.

While the present invention has been described in its presently preferred embodiments, for illustrative purpose only, the invention may be embodied with various changes, modifications and improvements which may occur to those skilled in the art, without departing from the scope of the appended claims. For example, the press working method of the present invention is applicable to production of various automobile parts, and may be favorably employed to form inner panels, such as a door inner panel, rear floor and wheelhouse inner panel, since the resulting formed pieces include fused and solidified portions formed by a laser beam, or embossed portions.

What is claimed is:

1. A method of effecting press working on a blank, comprising the steps of:

increasing mechanical strength of a local portion of said blank by heating said local portion by application of high energy and quenching said local portion, thereby to cause structural transformation of material in said local portion, said local portion being a portion of the blank to be elongated in a direction of elongation during an initial period of a pressing step, being prone to fracture due to stress concentration as the press working proceeds, and including at least one linear portion extending in the direction of elongation; and after increasing the strength of said local portion, effecting said pressing step wherein a central portion of said blank including said local portion is pressed against a punch while the blank is held under pressure at an outer peripheral portion thereof, so that the blank undergoes plastic deformation according to a shape of said punch, and so that said structural transformation of the material in said local portion in said step of strengthening contributes to prevention of fracture in said local portion due to stress concentration.

2. A method according to claim 1, wherein said local portion of the blank corresponds to a shoulder of said punch at which said local portion undergoes said plastic deformation in said pressing step.

3. A method of effecting press working on a blank, comprising the steps of:

increasing mechanical strength of a local portion of said blank by heating said local portion by application of a high energy and quenching said local portion, thereby to cause structural transformation of blank material in said local portion, said local portion being a portion of the blank to be subjected to a bulging operation in a pressing step during which an outer peripheral portion of said blank surrounding said local portion is held by a pressure member so as to restrict inward movement distance of said outer peripheral portion toward said local portion, said local portion including at least one linear portion extending in a direction in which a tension acts on said local portion during said bulging operation; and after increasing the strength of said local portion, effecting said pressing step wherein said blank is pressed against a punch so that the blank undergoes plastic deformation according to a shape of said punch, such that said structural transformation of the material in said local portion contributes to an increase in said inward movement distance.

4. A method according to claim 3, wherein said pressing step comprises holding said outer peripheral portion of the blank by and between a die and said pressure member which cooperate to provide means for restricting said inward movement of said outer peripheral portion.

5. A method of effecting press working on a blank, comprising the steps of:

increasing mechanical strength of a local portion of said blank by heating by application of high energy and quenching said local portion, thereby to cause structural transformation of blank material in said local portion, and so as to change type of plastic deformation of the blank in a pressing step to increase an upper limit amount of stain of the blank, said local portion including at least one linear portion; and after increasing mechanical strength of said local portion, effecting said pressing step wherein a central portion of said blank is pressed against a punch while the blank is held under pressure at an outer peripheral portion thereof, so that the blank undergoes plastic deformation according to a shape of said punch, which plastic deformation is different from that which would occur without said structural transformation of the material in said local portion.

6. A method according to claim 5, wherein said local portion of said blank includes a plurality of linearly strengthened portions extending in a direction perpendicular to a direction in which a tension acts on the local portion in said pressing step, such that said linearly strengthened portions are spaced apart from each other in said direction of the tension.

7. A method of effecting press working on a blank, comprising:

increasing mechanical strength of a local portion of said blank by heating said local portion by application of a high energy thereto and quenching said local portion, thereby to cause structural transformation of blank material in said local portion, said local portion being located near a portion of the blank which is to be bent in a pressing step, and at one of opposite surfaces of the blank which is to be located on the outer side of said portion to be bent, said local portion including at least one linear portion extending along said portion to be bent; and after increasing the mechanical strength of said local portion, effecting said pressing step wherein said blank is pressed to cause plastic deformation thereof according to a predetermined shape, such that said structural transformation of the material in said local portion contributes to reduction in an amount of springback of said blank.

8. A method according to claim 7, wherein said step of increasing mechanical strength of a local portion comprises strengthening two linear portions which extend in said direction of elongation and which are located on opposite sides of said portion to be bent.

9. A method of effecting press working on a blank, comprising the steps of:

increasing mechanical strength of a local portion of said blank by embossing said local portion so as to cause compressive deformation thereof for thereby improving formability of said blank in a pressing step; and after increasing strength of said local portion, effecting said pressing step wherein a central portion of said blank including said local portion is pressed against a punch while the blank is held under pressure at an outer peripheral portion thereof, so that the blank undergoes plastic deformation according to a shape of said punch, such that said compressive deformation of said local portion contributes to an improvement in said formability of the blank.

10. A method according to claim 9, wherein said local portion to be strengthened in said step of increasing strength includes a portion of the blank which is on an outer side of a bend formed in said pressing step.

11. A method according to claim 9, wherein said local portion to be strengthened in said step of increasing strength includes a plurality of portions of the blank which correspond to corners of a shoulder of said punch.

12. A method according to claim 9, wherein said local portion is a portion of the blank which is to be elongated during an initial period of said pressing step and which would be prone to fracture due to stress concentration as the press working proceeds if said local portion was not strengthened.

13. A method according to claim 9, wherein said local portion is a portion of the blank which is to be subjected to a bulging operation wherein said outer peripheral portion is held by a pressure member so as to restrict an inward movement of said outer peripheral portion toward said local portion.

14. A method according to claim 9, wherein said local portion is strengthened to change a type of plastic deformation of the blank in said pressing step.

15. A method according to claim 9, wherein said local portion is located near a portion of the blank which is to be bent in said pressing step and at one of opposite surfaces of the blank which is to be located on the outer side of said portion to be bent.

16. A method of effecting press working on a blank, comprising the steps of:

strengthening a local portion of said blank by application of a high energy thereto and subsequent quenching of said local portion, so as to cause structural transformation of a material in said local portion; and after strengthening said local portion, pressing a central portion of said blank against a punch while the blank is held at an outer peripheral portion thereof, so that the blank undergoes plastic deformation according to a shape of said punch, such that said structural transformation of the material in said local portion in said strengthening step contributes to improved formability of said blank.

* * * * *